US006579671B2

(12) United States Patent
Emmers et al.

(10) Patent No.: US 6,579,671 B2
(45) Date of Patent: Jun. 17, 2003

(54) RECORDING MATERIALS WITH IMPROVED SHELF-LIFE, IMAGE TONE AND/OR STABILITY UPON THERMAL DEVELOPMENT

(75) Inventors: Sabine Emmers, Lommel (BE); Bartholomeus Horsten, Rumat (BE); Ingrid Geuens, Ranst (BE); Yvan Gilliams, Pulle (BE); Dirk Bollen, Sint-Truiden (BE); Ivan Hoogmartens, Wilrijk (BE); Andre Bellens, Pulle (BE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/854,749

(22) Filed: May 14, 2001

(65) Prior Publication Data

US 2002/0150849 A1 Oct. 17, 2002

Related U.S. Application Data

(60) Continuation-in-part of application No. 09/271,653, filed on Mar. 17, 1999, now abandoned, which is a division of application No. 08/982,318, filed on Dec. 10, 1997, now Pat. No. 6,096,486, and a continuation-in-part of application No. 09/586,114, filed on Jun. 2, 2000, now abandoned, which is a division of application No. 09/323,860, filed on Jun. 1, 1999, now Pat. No. 6,127,102, and a continuation-in-part of application No. 09/586,113, filed on Jun. 2, 2000, now abandoned, which is a division of application No. 09/323,861, filed on Jun. 1, 1999, now Pat. No. 6,114,100.

(60) Provisional application No. 60/038,769, filed on Feb. 20, 1997, provisional application No. 60/096,563, filed on Aug. 14, 1998, and provisional application No. 60/096,562, filed on Aug. 14, 1998.

(51) Int. Cl.[7] ..... G03C 1/00

(52) U.S. Cl. ..... 430/620; 430/631; 554/74

(58) Field of Search ..... 430/620, 631; 554/74; 556/110

(56) References Cited

U.S. PATENT DOCUMENTS

| | | | |
|---|---|---|---|
| 3,457,075 | A | 7/1969 | Morgan et al. |
| 3,839,049 | A | 10/1974 | Simons |
| 3,856,527 | A | 12/1974 | Hamb et al. |
| 3,897,935 | A | 8/1975 | Forster et al. |
| 3,960,908 | A | 6/1976 | Ikenoue et al. |
| 4,152,162 | A | 5/1979 | Masuda et al. |
| 4,188,212 | A | 2/1980 | Fujiwara et al. |
| 4,210,717 | A | 7/1980 | Gatzke |
| 4,273,723 | A | 6/1981 | Hayashi et al. |
| 4,307,187 | A | 12/1981 | Ikenoue et al. |
| 4,473,504 | A | 9/1984 | Odashima et al. |
| 4,476,220 | A | 10/1984 | Penfound |
| 5,364,733 | A | 11/1994 | Kenney et al. |
| 5,747,412 | A | 5/1998 | Leenders et al. |
| 5,891,616 | A | 4/1999 | Gilliams et al. |
| 6,159,667 | A | 12/2000 | Emmers et al. |
| 6,180,165 | B1 | 1/2001 | Uyttendaele et al. |

FOREIGN PATENT DOCUMENTS

| | | | |
|---|---|---|---|
| BE | 877108 | | 10/1979 |
| EP | 0 754 969 | A2 | 1/1997 |
| EP | 0 848 286 | A1 | 6/1998 |
| EP | 0903628 | * | 3/1999 |
| GB | 1 347 350 | | 2/1974 |
| GB | 2 002 917 | A | 2/1979 |

OTHER PUBLICATIONS

U.S. patent application Ser. No. 08/999,409, Vandenabeele et al., pending.

Derwent Abstract for JP 58 028 737 and JP 2 026 214.

Chemical Data, Second Edition, John Wiley and Sons, Australia (1974).

* cited by examiner

*Primary Examiner*—Thorl Chea

(74) *Attorney, Agent, or Firm*—Leydig, Voit & Mayer, Ltd.

(57) ABSTRACT

A recording material comprising a support and a thermosensitive element containing one or more of silver behenate, silver palmitate, and silver stearate, an organic reducing agent therefor in thermal working relationship therewith and a binder, wherein the silver behenate, palmitate, or stearate is not associated with mercury and/or lead ions, production processes for particles of substantially light-insensitive organic silver salt primarily comprising silver behenate, silver palmitate, or stearate, with described X-ray characteristics in the substantial absence of organic solvent.

18 Claims, No Drawings

RECORDING MATERIALS WITH IMPROVED SHELF-LIFE, IMAGE TONE AND/OR STABILITY UPON THERMAL DEVELOPMENT

This application is a continuation-in-part of U.S. patent application Ser. No. 09/271,653, filed Mar. 17, 1999, now abandoned, which is a divisional of U.S. patent application Ser. No. 08/982,318 filed Dec. 10, 1997 now U.S. Pat. No. 6,096,486, which claims the benefit of US Provisional Application No. 60/038,769, filed Feb. 20, 1997, and U.S. patent application Ser. No. 09/586,114, filed Jun. 2, 2000 now abandoned which is a divisional of U.S. patent application Ser. No. 09/323,860, filed Jun. 1, 1999 now U.S. Pat. No. 6,127,102, which claims the benefit of U.S. Provisional Application No. 60/096,563, filed Aug. 14, 1998, and U.S. patent application Ser. No. 09/586,113, filed Jun. 2, 2000 now abandoned, which is a divisional of U.S. patent application Ser. No. 09/323,861, filed Jun. 1, 1999 now U.S. Pat. No. 6,114,100, which claims the benefit of U.S. Provisional Application No. 60/096,562, filed Aug. 14, 1998, all of which disclosures are incorporated herein by reference in their entirety.

FIELD OF THE INVENTION

The present invention relates to recording materials suitable for thermographic or photothermographic development. In particular, it concerns materials with improved shelf-life and prints with improved archivability produced with such materials.

BACKGROUND OF THE INVENTION

Thermal imaging or thermography is a recording process wherein images are generated by the use of thermal energy.

In direct thermography a visible image pattern is formed by image-wise heating of a recording material containing matter that by chemical or physical process changes color or optical density. Such recording materials become photothermographic upon incorporating a photosensitive agent, which after exposure to UV, visible or IR light, is capable of catalyzing or participating in a thermographic process bringing about changes in color or optical density.

Most of the "direct" thermographic recording materials are of the chemical type. On heating to a certain conversion temperature, an irreversible chemical reaction takes place and a colored image is produced.

According to U.S. Pat. No. 3,080,254 a typical heat-sensitive (thermographic) copy paper includes in the heat-sensitive layer a thermoplastic binder, a water-insoluble silver salt and an appropriate organic reducing agent. Thermosensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

GB-A 1,542,327 discloses a thermally developable light-sensitive sheet material, comprising a support and (a) a silver salt of an organic acid, (b) a catalyst in an amount capable of catalyzing the reaction in exposed areas of the material of components (a) and (c) after imagewise exposure and heating of the material, (c) a reducing agent for the silver salt, (a), and (d) sulphur in an amount to reduce the color change after processing and to reduce thermal fogging, the components (a) to (d) are contained, separately or together, in one or more layers coated on the support or being all present in the support or one or more of the components being present in the support and the remainder being in one or more layers coated thereon. The description of GB 1,542,327 includes an exhaustive list of silver salts of organic acids including silver palmitate. Furthermore, D. S. Avose, V. V. Tsvetkov and V. D. Yagodovskii in Sci. Appl. Photo. volume 35, pages 587–594 published in 1994 by Gordon and Breach Science Publishers S.A. describe photothermographic materials based on silver bromide and silver palmitate.

U.S. Pat. No. 4,273,723 discloses a process for preparing a silver salt of a fatty acid with 12 to 24 carbon atoms consisting essentially of reacting an alkali metal salt of the fatty acid with a water-soluble silver salt. The reaction is effected in a reaction system consisting essentially of (I) the alkali metal salt of the fatty acid, (II) the water-soluble silver salt, (IR) at least one water-soluble or partially water-soluble $C_3$–$C_8$ alcohol and (IV) water, the volume ratio of the component (III) to the component (IV) being from 1/5 to 5/1.

EP-A 754,969 discloses a process for producing a suspension of particles containing a substantially light-insensitive silver salt of an organic carboxylic acid. The process comprises simultaneous metered addition of an aqueous solution or suspension of an organic carboxylic acid or its salt and an aqueous solution of a silver salt to an aqueous liquid. The metered addition of the aqueous solution or suspension of the organic carboxylic acid or its salt and/or the aqueous solution of the silver salt is regulated by the concentration of silver ions or the concentration of anions of the silver salt in the aqueous liquid.

Research Disclosure number 17029, published in June 1978, in section II gives a survey of different methods of preparing organic heavy metal salts. Method 5, for example, describes the preparation of silver behenate by (a) heating behenic acid in water to a temperature above the melting point of the acid, but below the boiling point of the dispersion, (b) adding an aqueous solution of alkali metal or ammonium hydroxide, and (c) adding an aqueous solution of silver nitrate. However, in order to obtain a fine emulsion of an organic heavy metal salt, either the synthesis has to be carried out in an organic solvent medium as disclosed, for example, in U.S. Pat. No. 3,700,458 or in a mixture of water and a substantially water insoluble organic solvent as disclosed, for example, in U.S. Pat. No. 3,960,908 for silver carboxylates.

GB-A 1,378,734 discloses a process of producing a silver salt of an organic carboxylic acid, which comprises mixing (a) an aqueous solution of silver nitrate or a silver complex with (b) a solution of an organic carboxylic acid in a solvent in which the organic carboxylic acid is soluble. The solvent is chosen so that both the silver salt of an organic carboxylic acid and the silver nitrate are almost insoluble in the solvent and water is sparingly miscible in the solvent. In the mixture, the organic carboxylic acid reacts with silver ions. The reaction is conducted in the presence of a soluble mercury compound and/or a soluble lead compound.

The association of silver behenate, silver palmitate, or silver stearate with mercury or lead ions, particularly mercury ions, as disclosed in GB 1,378,734 is environmentally undesirable and infringes governmental regulations. Direct thermal recording materials with silver behenates produced using the processes described in RD 17029 exhibit a brown image color upon image-wise heating which is undesirable for medical images viewed in transmission with a viewing box. This lack of image color neutrality can be quantified by spectrophotometric measurements according to ASTM Norm E179-90 in a R(45/0) geometry with evaluation according to ASTM Norm E308-90 to produce the CIELAB a* and b* co-ordinates. Color neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive.

Additionally, recording materials prepared using prior art silver palmitate processes and compounds exhibit poor shelf-life. Recording materials prepared using prior art silver stearate processes and compounds also exhibit poor shelf-life and prints produced with these materials exhibit poor archivability, particularly as regards increase in $D_{max}$.

SUMMARY OF THE INVENTION

Objects of the Invention

It is therefore an object of the invention to provide recording materials with improved shelf-life.

It is a further object of the present invention to provide thermographic and photothermographic recording materials whose prints exhibit improved archivability and light stability.

It is a still further object of the present invention to provide a production process for substantially light-insensitive organic silver salts comprising silver behenate, palmitate, and/or stearate.

Further objects and advantages of the invention will become apparent from the description below.

Surprisingly, it has been found that recording materials comprising a support and a thermosensitive element comprising silver behenate, silver palmitate or silver stearate with a higher crystallinity than respective prior art organic silver salts, an organic reducing agent therefor in thermal working relationship therewith and a binder exhibit a marked improvement in shelf-life and/or archivability of prints produced with the recording materials relative to recording materials of the prior art.

The above mentioned objects of the invention are realized with a recording material comprising a support and a thermosensitive element containing silver behenate, silver palmitate or silver stearate, an organic reducing agent therefor in thermal working relationship therewith, and a binder. In the present invention the silver behenate, silver palmitate, and silver stearate are not associated with mercury and/or lead ions. When the recording material comprises silver behenate and is irradiated with a copper $K\alpha_1$ X-ray source, the ratio, normalized to a quantity of silver in the recording material of 1 g per m thereof, of the sum of the peak heights of the X-ray diffraction lines attributable to silver behenate at Bragg angles, 2Θ of 6.01°, 7.56°, 9.12°, 10.66°, 12.12° and 13.62° to the sum of the peak heights of the X-ray diffraction lines at Bragg angles, 2Θ, of 25.6°, 35.16° and 43.40° of NIST standard 1976, rhombohedral $Al_2O_3$, determined wit the same X-ray diffractometer in the same state of adjustment on a sample of the recording material and a sample of the NIST standard 1976 cut to fit a sample holder of the X-ray diffractometer, is greater than 0.85 $m^2/g$.

When the recording material comprises silver palmitate and is irradiated with a copper $K\alpha_1$ X-ray source, the ratio of the sum of the peak heights of the X-ray diffraction lines attributable to silver palmitate at Bragg angles, 2Θ, of 4.01°, 6,049°, 8,031°, 10.06°, 12.08° and 14.09° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 3.09 $m/g^{0.5}$.

When the recording material comprises silver stearate and is irradiated with a copper $K\alpha_1$ X-ray source, the ratio of the sum of the peak heights of the X-ray diffraction lines attributable to silver stearate at Bragg angles, 2Θ, of 3.62°, 5.45°, 7.30°, 9,04°, 10.97° and 12.71° to the sum of the peak heights of the X-ray diffraction lines at Bragg angles, 2Θ, of 25.60°, 35.16° and 43.40° of NIST standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 2.2 $m/g^{0.5}$.

A recording process according to the present invention is also provided comprising: (i) bringing an outermost layer of an above described recording material in proximity with a heat source; and (ii) applying heat from the source to the recording material while maintaining proximity to the heat source to produce an image; and (iii) removing the recording material from the heat source.

A production process for particles of substantially light-insensitive organic silver salts comprising silver behenate according to the present invention is also provided comprising: i) producing a solution or dispersion, A, comprising an alkali metal or ammonium salt of an organic compound with at least one acidic hydrogen atom in a mixture of water and an organic solvent at a temperature at which particles of the substantially light-insensitive organic silver salt comprising silver behenate do not undergo reduction; and ii) adding a quantity of an aqueous solution, B, of a silver salt containing an equal number of silver ions to the alkali or ammonium ions in the solution or dispersion A. The process is further characterized in that the initial mixing number during the addition of the aqueous solution B to the solution or dispersion A is greater than or equal to $2\times10^{-4}$ during the production of the particles of substantially light-insensitive organic silver salt. The mixing number is the ratio of the molar rate at which the silver salt in solution B is supplied to solution A in a reactor to the molar rate at which the alkali or ammonium salt is circulated in the reactor.

A production process for a dispersion of particles of substantially light-insensitive organic silver salts primarily including a silver salt of an organic carboxylic acid in a substantially solvent-free aqueous medium according to the present invention is also provided. The process comprises: i) preparing an aqueous dispersion of one or more organic acids primarily including the organic carboxylic acid and an anionic surfactant; ii) substantially neutralizing the organic acids with aqueous alkali, thereby forming organic acid salts primarily including the salt of the organic carboxylic acid; (iii) adding an aqueous solution of a silver salt to completely convert the organic acid salt(s) into their silver salts primarily including the silver salt of the organic carboxylic acid. During the production process, the anionic surfactant is present in a molar ratio with respect to organic acid greater than 0.15 and the silver salt is added at a rate between 0.025 mol/(mol organic silver salt×min) and 2.25 mol/(mol organic silver salt×min).

Preferred embodiments of the invention are disclosed in the detailed description.

DETAILED DESCRIPTION OF THE INVENTION

In a preferred embodiment of the recording process of the present invention, the heat source is a thermal head. In a more preferred embodiment, it is a thin film thermal head.

Substantially light-insensitive, as used in this application, means not intentionally light sensitive. A substantially solvent-free aqueous medium as used in this application is a medium in which a solvent, if present, is present in amounts below 10% by volume of the aqueous medium.

Absence of Mercury or Lead

The silver behenate, silver palmitate and silver stearate of the present invention is not associated with mercury and/or lead ions. This means that mercury/and or lead ions are not intentionally added at any point during the preparation process and, therefore, are not intentionally associated with the silver behenate, silver palmitate and silver stearate present in the recording material of the present invention.

Thermosensitive Element

The thermosensitive element, according to the present invention, comprises one or more of silver behenate, silver palmitate and silver stearate, an organic reducing agent therefor in thermal working relationship therewith, and a binder. The element may comprise a layer system in which the ingredients may be dispersed in different layers, provided that the two ingredients are in reactive association with one another. However, during the thermal development process, the reducing agent must be present in such a way that it is able to diffuse to the silver behenate, silver palmitate and silver stearate present so that reduction of the silver behenate, silver palmitate and silver stearate present to silver can occur, giving the desired image-tone.

In a preferred embodiment of the present invention the thermosensitive element further comprises a photosensitive species capable, upon exposure to light, of forming another species capable of catalyzing reduction of the silver behenate, silver palmitate, and silver stearate present.

Silver Behenate Characterization

If the organic silver salt in the recording material of the present invention primarily comprises silver behenate then, when irradiated with a copper $K\alpha_1$ X-ray source the ratio, normalized to a quantity of silver in the recording material of 1 g per $m^2$ thereof, of the sum of the peak heights of the X-ray diffraction lines attributable to silver behenate at Bragg angles, 2Θ, of 6.01°, 7.56°, 9.12°, 10.66°, 12.12° and 13.62° to the sum of the peak heights of the X-ray diffraction lines at Bragg angles, 2Θ, of 25.60°, 35.16° and 43.40° of NIST (National Institute of Standards, Gaithersburg, Md. 20899-0001, USA) standard 1976, rhombohedral $Al_2O_3$, determined with the same X-ray diffractometer in the same state of adjustment, is greater than 0.85 $m^2/g$. In a preferred embodiment of the present invention, the normalized ratio, as defined above, is greater than 1.0 $m^2/g$ and in a particularly preferred embodiment is greater than 1.2 $m^2/g$.

The normalized ratio is obtained by determining X-ray diffraction spectra on sheets of a particular recording material and of the NIST standard 1976 cut to fit the sample holder of the X-ray diffractometer used, subtracting the background using standard techniques, determining the peak heights of the diffraction peaks, determining for the sample of recording material the sum of the peak heights, $K_{material}$, of the XRD lines attributable to silver behenate at Bragg angles, 2Θ, of 6.01°, 7.56°, 9.12°, 10.66°, 12.12° and 13.62°, determining for the sample of NIST standard 1976 the sum of the peak heights, $K_{1976}$, of the X-ray diffraction lines at Bragg angles, 2Θ, of 25.60°, 35.16° and 43.40°, calculating the ratio of $K_{material}/K_{1976}$ for the recording material, determining the concentration of silver $C_{Ag}$ present in the recording material in grams per square meter of material and finally normalizing the ratio $K_{material}/K_{1976}$ with $C_{Ag}$ to give the normalized ratio $K_{material}/(K_{1976}\times C_{Ag})$, which is referred to in the detailed description of the present invention as the crystallinity of silver behenate. The exact positions of the peaks attributable to silver behenate can vary within 0.3° of the angles given above. In such cases the peak height should be taken as the actual peak height of the peak and not the height of the peak at the angle given above.

The concentration of silver present in the recording material can be determined by any known technique e.g. non-destructive methods such as X-ray fluorescence and destructive methods such as dissolution of the silver salt followed by standard volumetric techniques for the determination of silver, such as described in R. Belcher and A. J. Nutten, Quantitative Inorganic Analysis, 2nd Edition, Butterworths, London (1960), pages 201–219.

A standard test was used to assess the image tone of thermographic recording materials comprising silver behenate of the present invention. This consisted of first coating a subbed 175 μm thick polyethylene terephthalate support with a solvent dispersion comprising: silver behenate (AgB), 400% by weight relative to AgB of polyvinylbutyral, 50 mol % relative to AgB of ethyl 3,4-dihydroxybenzoate, 15 mol % relative to AgB of benzo[e][1,3]oxazine-2,4-dione, 5 mol % relative to AgB of 7-(ethylcarbonato)-benzo[e][1,3]oxazine-2,4-dione, 0.9 wt % of silicone oil relative to AgB, 5 mol % relative to AgB of tetrachlorophthalic anhydride, 21.98 mol % relative to AgB of adipic acid and 10 mol % relative to AgB of benzotriazole to a coating weight of AgB of about 5 $g/m^2$. After drying for 1 hour at 50° C., the thermographic recording material was tempered for 7 days at 45° C. Thermal printing was carried out with the print head separated from the thermosensitive layer by a separable 5 μm thick polyethylene terephthalate ribbon coated successively with a subbing layer, heat-resistant layer and a slipping layer (anti-friction layer) and a printer equipped with a thin film thermal head with a resolution of 300 dpi and operated with a line time of 19 ms (the line time being the time needed for printing one line). During the line time the print head received constant power. The average printing power, being the total amount of electrical input energy during one line time divided by the line time and by the surface area of the heat-generating resistors was 1.5 mJ/dot. The image tone was assessed both by visual inspection and on the basis of the L*, a* and b* CIELAB-values of the image as a function of the optical density of the image determined with a MacBeth™ TR924 densitometer. The L*, a* and b* CIELAB-values were determined by spectrophotometric measurements according to ASTM Norm E179-90 in a R(45/0) geometry with evaluation according to ASTM Norm E308-90. The value of b* at the minimum in the dependence of b* upon image density of less than −2.0 was found to correspond with an image with a blue tone compared with images with a brown tone for minima with higher b* values.

Silver Palmitate Characterisation

If the organic silver salt in the recording material of the present invention primarily comprises silver palmitate, when the recording material is irradiated with a copper $K\alpha_1$ X-ray source the ratio of the sum of the peak heights of the X-ray diffraction lines attributable to silver palmitate at Bragg angles, 2Θ, of 4.01°, 6,049°, 8,031°, 10.06°, 12.08° and 14.09° to the sum of the peak heights of the X-ray diffraction lines at Bragg angles, 2Θ, of 25.60°, 35.16° and 43.40° of NIST (National Institute of Standards, Gaithersburg, Md. 20899-0001, USA) standard 1976, rhombohedral $Al_2O_3$, determined with the same X-ray diffractometer in the same state of adjustment, divided by the square root of the quantity of silver in the recording material, expressed in g per $m^2$, is greater than 3.09 $m/g^{0.5}$, which is referred to in the detailed description of the present invention as the crystallinity of silver palmitate. In a preferred embodiment of the present invention, the crystallinity of silver palmitate is greater than 3.3 $m/g^{0.5}$ and, in a particularly preferred embodiment, is greater than 3.8 $m/g^{0.5}$.

The crystallinity of the silver palmitate in the recording material of the present invention is obtained by determining X-ray diffraction spectra on sheets of a particular recording material and of the NIST standard 1976 cut to fit the sample holder of the X-ray diffractometer used, subtracting the background using standard techniques, determining the peak heights (maxima) of the diffraction peaks, determining for the sample of recording material the sum of the peak heights (maxima), $K_{material}$, of the XRD lines attributable to silver palmitate at Bragg angles, 2Θ, of 4.01°, 6,049°, 8,031°, 10.06°, 12.08° and 14.09°, determining for the sample of NIST standard 1976 the sum of the peak heights (maxima), $K_{1976}$, of the X-ray diffraction lines at Bragg angles, 2Θ, of 25.60°, 35.16° and 43.40°, calculating the ratio of $K_{material}/K_{1976}$ for the recording material, determining the concentration of silver $C_{Ag}$ present in the recording material in grams per square meter of material and finally normalizing the ratio $K_{material}/K_{1976}$ with $\sqrt{C_{Ag}}$ to give $K_{material}/(K_{1976} \times \sqrt{C_{Ag}})$, which is a relative crystallinity for the silver palmitate in the recording material concerned. The exact positions of the peaks attributable to silver palmitate can vary within 0.3° of the angles given above. In such cases the peak height should be taken as the actual peak height of the peak and not the height of the peak at the angle given above.

The concentration of silver present in the recording material can be determined by any known technique, e.g. non-destructive methods such as X-ray fluorescence and destructive methods such as dissolution of the silver salt followed by standard volumetric techniques for the determination of silver, as described in R. Belcher and A. J. Nutten, Quantitative Inorganic Analysis, 2nd Edition, Butterworths, London (1960), pages 201–219.

Silver Stearate Characterization

If the organic silver salt in the recording material of the present invention primarily comprises silver stearate when the recording material is irradiated with a copper $K\alpha_1$ X-ray source the ratio of the sum of the peak heights of the X-ray diffraction lines attributable to silver stearate at Bragg angles, 2Θ, of 3,62°, 5.45°, 7.30°, 9,04°, 10.97° and 12.71° to the sum of the peak heights of the X-ray diffraction lines at Bragg angles, 2Θ, of 25.60°, 35.16° and 43.40° of NIST (National Institute of Standards, Gaithersburg, Md. 20899-0001, USA) standard 1976, rhombohedral $Al_2O_3$, determined with the same X-ray diffractometer in the same state of adjustment on a sample of the recording material and a sample of the NIST standard 1976 cut to fit a sample holder of the X-ray diffractometer, divided by the square root of the quantity of silver in the recording material, expressed in g per $m^2$, is greater than 2.2 $m/g^{0.5}$, which is referred to in the detailed description of the present invention as the crystallinity of silver stearate. In a preferred embodiment of the present invention, the crystallinity of silver stearate is greater than 3.0 $m/g^{0.5}$.

The crystallinity of the silver stearate in the recording material of the present invention is obtained by determining X-ray diffraction spectra on sheets of a particular recording material and of the NIST standard 1976 cut to fit the sample holder of the X-ray diffractometer used, subtracting the background using standard techniques, determining the peak heights (maxima) of the diffraction peaks, determining for the sample of recording material the sum of the peak heights (maxima), $K_{material}$, of the XRD lines attributable to silver stearate at Bragg angles, 2Θ, of 3.62°, 5.45°, 7.30°, 9.04°, 10.97° and 12.71°, determining for the sample of NIST standard the sum of the peak heights (maxima), $K_{1976}$, of the X-ray diffraction lines at Bragg angles, 2Θ, of 25.60°, 35.16° and 43.40°, calculating the ratio Of $K_{material}/K_{976}$ for the recording material, determining the concentration of silver $C_{Ag}$ present in the recording material in grams per square meter of material and finally normalizing the ratio $K_{material}/K_{1976}$ with $\sqrt{C_{Ag}}$ to give $K_{material}/(K_{1976} \times C_{Ag})$, which is a relative crystallinity for the silver stearate in the recording material concerned. The exact positions of the peaks attributable to silver stearate can vary within 0.3° of the angles given above. In such cases the peak height should be taken as the actual peak height of the peak and not the height of the peak at the angle given above.

The concentration of silver present in the recording material can be determined by any known technique e.g. non-destructive methods such as X-ray fluorescence and destructive methods such as dissolution of the silver salt followed by standard volumetric techniques for the determination of silver, such as described in R. Belcher and A. J. Nutten, Quantitative Inorganic Analysis, 2nd Edition, Butterworths, London (1960), pages 201–219.

Organic Silver Salt Particles Primarily Containing a Silver Salt of an Organic Carboxylic Acid By the term "primarily includes a silver salt of an organic carboxylic acid" it is meant that more of the particular silver salt of an organic carboxylic acid is present in the particle than other types of organic silver salts e.g. in the case of silver behenate than other organic silver salts such as silver palmitate and silver stearate. The term "primarily including a silver salt of an organic carboxylic acid" may also refer to a substantially light insensitive organic silver salt that comprises only one silver salt of an organic carboxylic acid. The particles of substantially light-insensitive organic silver salts primarily containing a silver salt of an organic carboxylic acid preferably contain at least 50 mol % of the silver salt of an organic carboxylic acid.

The silver salt of an organic carboxylic acid primarily included in the particles of substantially light-insensitive organic silver salts according to the invention is preferably the silver salt of an aliphatic carboxylic acid, with silver salts of an aliphatic acid wherein the aliphatic carbon chain has at least 12 carbon atoms being particularly preferred e.g. silver laurate, silver stearate, silver hydroxystearate, silver behenate and silver arichidate. Especially preferred silver salts of an organic carboxylic acid primarily included in the particles of substantially light-insensitive organic silver salts according to the invention are silver behenate, silver palmitate and silver stearate The substantially light-insensitive organic silver salts for use in the recording materials of the present invention together with the silver salts of an organic carboxylic acid are silver salts of any non-present aliphatic carboxylic acids known as fatty acids, wherein the aliphatic carbon chain has preferably at least 12 C-atoms, e.g. silver laurate, silver stearate, silver hydroxystearate, silver behenate and silver arichidate, silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image.

Compounds for Promoting Silver Behenate Crystallinity

Non-halide ions containing phosphonium compounds have been found to promote the crystallinity of silver behenate. Preferred non-halide ion containing phosphonium compounds for promoting silver behenate crystallinity according to the present invention are:

PC01=(2-methoxyethyl)triphenylphosphonium toluenesulphonate

PC02=ethyltriphenylphosphonium toluenesulphonate

PC03=(2-triphenylphosphonium)ethyltriphenylphosphonium benzenesulphonate

Silver Behenate Preparation in Solvent/Water Media

Any known synthesis technique and any known dispersion technique can be used to produce the silver behenate of the present invention with the provision that the silver behenate in the thermographic recording material of the present invention fulfils the above criteria set forth under "silver behenate characterization".

In a preferred embodiment of the recording material of the present invention, the silver behenate is present in the thermosensitive element as particles of a substantially light-insensitive organic silver salts primarily comprising silver behenate. By the term "primarily comprising silver behenate" it is meant that more silver behenate is present in the mixture of organic silver salts than other types of organic silver salts such as silver palmitate or silver stearate. The term "primarily comprising silver behenate" may also refer to a substantially light insensitive organic silver salt that comprises only one organic silver salt, silver behenate.

A production process for particles of substantially light-insensitive organic silver salts, primarily comprising silver behenate, comprises: i) producing a solution or dispersion, A, comprising an alkali metal or ammonium salt of an organic compound with at least one acidic hydrogen atom and further comprising behenic acid in a mixture of water and an organic solvent at a temperature at which particles of substantially light insensitive organic silver salts including silver behenate do not undergo reduction; and ii) adding a quantity of an aqueous solution, B, of a silver salt containing an equal number of silver ions to the alkali or ammonium ions in the solution or dispersion, A.

The above described production process for particles of substantially light-insensitive organic silver salts primarily comprising silver behenate is further characterized in that the mixing number during the addition of the aqueous solution B to the solution or dispersion A is greater than or equal to $2\times10^{-4}$ during the production of the particles of substantially light-insensitive organic silver salts primarily comprising silver behenate. The mixing number is the ratio of the molar rate at which the silver salt is supplied to the solution A in a reactor to the molar rate at which the alkali or ammonium salt is circulated in the reactor. The mixing number can be expressed as follows:

mixing number, $$MN = MN_0 \times \frac{1 + \frac{dV_B}{dt} \times \frac{t}{V_0}}{1 - \frac{C_B}{M_0} \times \frac{dV_B}{dt} \times t}$$

where $$MN_0 = \frac{\frac{dV_B}{dt} \times C_B}{\frac{M_0}{V_0} \times G_F \times D^3 \times n}$$

$$\frac{dV_B}{dt} = \text{rate of addition of solution } B \text{ in dm}^3\text{/minute}$$

rate of addition of solution B in $dm^3$/minute.

$C_B$=concentration of solution B in moles/$dm^3$ $M_0$=initial quantity of alkali metal or ammonium salt of an organic compound with at least one acidic hydrogen atom comprising behenic acid present in solution A in moles $V_0$=volume of solution A in the reactor in $dm^3$ $G_F$=pumping number of the stirrer in the reactor n=stirring rate in rotations/minute D=stirrer diameter in dm t=time in minutes The pumping number of the stirrer in a reactor is the ratio of stirrer pumping rate to the product of the stirrer diameter cubed and the stirring rate ($n\times D^3$) and is dependent on a variety of factors, such as the ratio of stirrer to reactor diameter, the off-bottom clearance ratio of the stirrer and the Reynolds number of the stirrer, see for example A. Bakker and L. E. Gates, Chemical Engineering Progress pages 25 to 34 (December 1995) and Nagata, "Mixing Principles and Applications", J. Wiley & Sons, New York (1975), pages 136–139.

The mathematical nature of the above function for the mixing number is such that the mixing number will always increase as the preparation of the particles of organic silver salts primarily comprising silver behenate proceeds.

In a preferred production process of the present invention, the solution or dispersion A has a molar concentration of alkali metal or ammonium salt of organic carboxylic acid compound with at least one acidic hydrogen atom comprising behenic acid in the mixture of water and an organic solvent greater than 0.022.

In another preferred production process of the present invention, the organic solvent is present at between 20 and 80% by weight of the mixture and preferably between 35 and 65% by weight of the mixture. In a further preferred production process, the organic solvent is 2-butanone.

Surprisingly, it has been found from scanning electron micrographs of dispersions of particles of organic silver salt comprising silver behenate and from transition electron micrographs of thin slices of thermosensitive layers coated from dispersions of particles of organic silver salts primarily comprising silver behenate that the shape of these particles in general changes from rods to a more globular shape as the mixing number is increased. It has also been found that this change in particle morphology is accompanied by an increase in the crystallinity, as defined above, provided that the dispersion of these particles of organic silver salts primarily comprising silver behenate is carried out under similar conditions. In a preferred embodiment of the recording material of the present invention, at least 20% by weight of the particles of organic silver salts primarily comprising silver behenate are present as globular particles and, in a particularly preferred embodiment of the recording material of the present invention, at least 40% by weight of the particles of organic silver salts primarily comprising silver behenate are present as globular particles.

Preparation of Aqueous Dispersions of Particles Primarily Containing Silver Behenate, Silver Palmitate or Silver Stearate in the Substantial Absence of Solvent A production process for a dispersion of particles of substantially light-insensitive organic silver salt primarily including a silver salt of an organic carboxylic acid in a substantially solvent-free aqueous medium according to the present invention the process comprises: i) preparing an aqueous dispersion of one or more organic acids primarily including the organic carboxylic acid and a salt of an anionic surfactant such as alkylarylsulfonate; ii) substantially neutralizing the organic acids with aqueous alkali, thereby forming organic acid salts primarily including a salt of the organic carboxylic acid; (iii) adding an aqueous solution of a silver salt to completely convert the organic acid salts into their silver salts primarily including the silver salt of the organic carboxylic acid. Preferred organic carboxylic acids are aliphatic carboxylic acids, with aliphatic carboxylic acid wherein the aliphatic carbon chain has at least 12 carbon atoms being particularly preferred e.g. lauric acid, palmitic acid, stearic acid, hydroxystearic acid, behenic acid and arichidic acid. Especially preferred organic carboxylic acids are behenic acid, palmitic acid and stearic acid.

During the production process, the anionic surfactant is present in a molar ratio with respect to organic acid greater than 0.15 and the silver salt is added at a rate between 0.025 mol/(mol organic silver salt×min) and 2.25 mol/(mol organic silver salt×min).

In a preferred embodiment of the production process, the anionic surfactant is present in a molar ratio with respect to organic carboxylic acid greater than 0.25 and the silver salt is added at a rate between 0.03 mol/(mol organic silver salt×min) and 0.7 mol/(mol organic silver salt×min). In a further preferred embodiment, the molar ratio of anionic surfactant with respect to organic acid is greater than 0.3 and the rate of silver salt addition is between 0.04 mol/(mol organic silver salt×min) and 0.3 mol/(mol organic silver salt×min).

In another preferred embodiment, step (iii) of the production process of the present invention is carried out such that part the solution of organic carboxylic acid salts produced in step (ii) of the process is present in the reaction vessel prior to silver salt solution addition and part thereof is added simultaneously with the addition of the silver salt solution. In a particularly preferred embodiment, about 25 to 50% of the solution of acid salts produced in step (ii) is in the reaction vessel prior to silver salt addition. The remainder is added to the vessel after or during silver salt addition.

In another preferred embodiment the anionic surfactant is selected from the group consisting of: alkylsulfonate salts, alkarylsulfonate salts, aralkylsulfonate salts, arylsulfonate salts, alkylsulfate salts, aralkylsulfate salts, arylsulfate salts, alkarylsulfate salts and organic carboxylate salts. In a particularly preferred embodiment of the present invention the anionic surfactant is an alkarylsulfonate salt and in an especially preferred embodiment the anionic surfactant is an alkylbenzene sulfonate salt.

Suitable anionic surfactants for use the present invention include the commercially available:

Surfactant Nr. 1=MARLON™ A-396, a sodium alkylphenylsulfonate from Hüls;

Surfactant Nr. 2=Marlon™ A-S3, an alkylphenylsulfonic acid from Hüls neutralized with an alkali hydroxide;

Surfactant Nr. 3=ammonium 4-dodecylbenzene sulfonate;

Surfactant Nr. 4=ULTRAVON™ W, a sodium arylsulfonate from Ciba-Geigy;

Surfactant Nr. 5=ERKANTOL™ BX, a sodium diisopropyl-naphthalenesulfonate from BAYER;

Surfactant Nr. 6=ALKANOL™ XC, a sodium nonylnaphthalene-sulfonate from DU PONT;

Surfactant Nr. 7=HOSTAPUR™, a secondary alkanesulfonate from HOECHST;

Surfactant Nr. 8=MERSOLAT™ H80, a sodium hexadecylsulfonate from Bayer;

Surfactant Nr. 9=HOSTAPAL™ B, a sodium trisalkylphenyl-polyethyleneglycol(EO 7-8) sulphate from Hoechst;

Surfactant Nr. 10=TERGITOL™ 4, a sodium 1-(2'-ethylbutyl)-4-ethylhexylsulphate from GOLDSCHMIDT;

In the above-described production process, the pH of the aqueous medium must be sufficiently low to avoid the oxidation of silver ions to silver oxide or silver hydroxide. A pH below 10 is usually sufficient. Additionally, the process temperature should be chosen so that it is above the melting point of the organic acid(s) used. In the case of an organic acid primarily comprising behenic acid a temperature of about 80 to 85° C. is appropriate, in the case of an organic acid primarily comprising palmitic acid a temperature of 65° C. is appropriate and in the case of stearic acid a temperature of around 75° C. is preferred. The process should be carried out with stirring, the stirring rate being dependent upon the size of the stirrer relative to the size of the reaction vessel and the type of stirrer used. Stirring should be adjusted to avoid silver oxide or silver hydroxide formation due to insufficient mixing and also to avoid foaming. A stirring rate of between 200 and 1000 rpm, is preferably used. Also in a preferred embodiment a slight excess of an organic acid, for example behenic acid at an e.g. 2 mol % excess may be provided.

The size of the silver acid salt particles primarily containing the silver salt of a carboxylic acid can be varied by varying the rate of silver salt addition, the concentration of anionic surfactant and the temperature. The diameter of the particles generally increases with decreasing addition rate, decreasing anionic surfactant concentration, or increasing temperature.

In a further preferred embodiment the production process also includes a step in which the organic silver salts primarily including the silver salt of a carboxylic acid are subject to ultrafiltration. The ultrafiltration process removes ionic species and concentrates the dispersion of particles primarily containing the silver salt of a carboxylic acid by filtration through a cartridge-filter with a pore size sufficient to remove particles of organic silver salts with a molecular weight substantially smaller than the silver salt of a carboxylic acid. Cartridge-filters having a 10 000 to 500 000 MW cut-off have been found to be suitable for this purpose.

In order to maintain the stability of the dispersion of particles primarily including the silver salt of a carboxylic acid during ultrafiltration it is necessary to maintain a minimum anionic surfactant concentration, but the counterion of the anionic surfactant can be changed, should the presence of the original counterion be undesirable in the thermographic recording material. For example, the sodium ions in Surfactant Nr 1 can be replaced by ammonium ions by washing with an ammonium nitrate solution during the ultrafiltration process to reduce the sodium ion concentration to below 100 ppm.

The above-mentioned process produces substantially light-insensitive organic silver salt particles primarily containing silver behenate in which the silver behenate has a crystallinity, as defined above for silver behenate, greater than 0.85 $m^2/g$.

The above-mentioned process produces substantially light-insensitive organic silver salt particles primarily containing silver palmitate in which the silver palmitate has a crystallinity, as defined above for silver palmitate, greater than 3.09 $m/g^{0.5}$.

The above-mentioned process produces substantially light-insensitive organic silver salt particles primarily containing silver stearate in which the silver stearate has a crystallinity, as defined above for silver stearate, greater than 2.2 $m/g^5$.

Substantially Light-Insensitive Organic Silver Salt Dispersions

In the case of dried particles of organic silver salts primarily comprising silver behenate, silver palmitate, or silver stearate with higher crystallinity, it has been found that recording materials, according to the present invention can be produced if dispersions thereof are produced using dispersion techniques in which the particles themselves are subjected to as little damage as possible commensurate with achieving a satisfactory dispersion quality. In a preferred embodiment, microfluidizers, ultrasonic apparatuses, rotor stator mixers etc. may be used for dispersion.

Surfactants and Dispersion Agents

Surfactants and dispersants aid the dispersion of ingredients or reactants which are insoluble in a particular dispersion medium. The thermographic recording materials of the present invention may contain one or more such surfactants, which may be anionic, non-ionic or cationic, and one or more such dispersants.

Suitable dispersants are natural polymeric substances, synthetic polymeric substances and finely divided powders, for example finely divided non-metallic inorganic powders such as silica. Suitable hydrophilic natural or synthetic polymeric substances contain one or more hydroxyl, carboxyl or phosphate groups, e.g. protein-type binders such as gelatin, casein, collagen, albumin and modified gelatin; modified cellulose; starch; modified starch; modified sugars; modified dextrans etc. Examples of suitable hydrophilic synthetic polymeric substances are polyvinylalcohol; polyvinylpyrrolidone; polyacrylic acid; and polymethacrylic acid and their copolymers.

Reducing Agents

Suitable organic reducing agents for the reduction of particles of organic silver salts primarily comprising silver behenate, silver palmitate, or silver stearate are organic compounds containing at least one active hydrogen atom linked to O, N, or C. Suitable reducing agents include: aromatic di- and tri-hydroxy compounds; aminophenols; METOL (tradename); p-phenylene-diamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as those described in U.S. Pat. No. 4,082,901; hydrazine derivatives; and reductones such as, ascorbic acid. See also U.S. Pat. No. 3,074,809, U.S. Pat. No. 3,080,254, U.S. Pat. No. 3,094,417 and U.S. Pat. No. 3,887,378 for further examples.

Useful aromatic di- and tri-hydroxy compounds include those having at least two hydroxy groups in ortho- or para-position on the same aromatic nucleus, such as benzene nucleus, hydroquinone and substituted hydroquinones, catechol, pyrogallol, gallic acid and gallic acid esters. Polyhydroxy spiro-bis-indane compounds are particularly preferred.

Among the catechol-type reducing agents, i.e. reducing agents containing at least one benzene nucleus with two hydroxy groups(—OH) in ortho-position, the following are preferred: catechol, 3-(3',4'-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents are described in EP-B 692 733, and EP-A 903 625.

Other suitable reducing agents, particularly for photothermographic recording materials, are sterically hindered phenols, bisphenols and sulfonamidophenols.

Combinations of reducing agents may also be used that on heating the agents become reactive partners in the reduction of the substantially light-insensitive organic silver salts primarily comprising silver behenate, silver palmitate, or silver stearate. For example, combinations of reducing agents with sulfonamidophenols are described in the periodical Research Disclosure, February 1979, item 17842, in U.S. Pat. No. 4,36°,581 and U.S. Pat. No. 4,782,004, and in EP-A 423 891. Combinations of sterically hindered phenols with sulfonyl hydrazide reducing agents are disclosed in U.S. Pat. No. 5,464,738. Combinations of trityl hydrazides and formyl-phenyl-hydrazides are disclosed in U.S. Pat. No. 5,496,695. Combinations of trityl hydrazides and formyl-phenyl-hydrazides with diverse auxiliary reducing agents are disclosed in U.S. Pat. No. 5,545,505, U.S. Pat. No. 5.545.507 and U.S. Pat. No. 5,558,983. Acrylonitrile compounds are disclosed in U.S. Pat. No. 5,545,515 and U.S. Pat. No. 5,635,339. 2-substituted malondialdehyde compounds are disclosed in U.S. Pat. No. 5,654,130. Organic reducing metal salts, such as stannous stearate, have also been used in such reducing agent combinations, as disclosed in U.S. Pat. No. 3,460,946 and U.S. Pat. No. 3,547,648. Sterically hindered phenols and bisphenols have also been used in such reducing agent combinations such as those described in U.S. Pat. No. 4,001,026 and U.S. Pat. No. 3,547,648, respectively.

The silver image density depends on the coverage of the above defined reducing agent(s) and organic silver salt(s) and has preferably be adjusted so that, upon heating above 100° C., an optical density of at least 2.5 may be obtained. Preferably, at least 0.10 moles of reducing agent per mole of organic silver salts is used.

Polycarboxylic Acids and Anhydrides Thereof

The thermosensitive element of the recording material of the present invention may additionally comprise at least one polycarboxylic acid and/or anhydride thereof in a molar percentage of at least 20 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid. These polycarboxylic acids may be substituted with for example, an alkyl, hydroxyl, nitro or halogen group. They may be used in anhydride form or partially esterified so long as at least two free carboxylic acids remain or are available during the heat recording step.

In a preferred embodiment, the polycarboxylic acids are saturated aliphatic dicarboxylic acids containing at least 4 carbon atoms, such as succinic acid, glutaric acid, adipic acid, pimelic acid, suberic acid, azelaic acid, sebacic acid, nonane-dicarboxylic acid, decane-dicarboxylic acid, and undecane-dicarboxylic acid.

In another preferred embodiment, the polycarboxylic acids are unsaturated dicarboxylic acids, such as maleic acid, citraconic acid, itaconic acid and aconitic acid. Suitable polycarboxylic acids are citric acid and derivatives thereof, acetonedicarboxylic acid, iso-citric acid, or α-ketoglutaric acid.

In yet another preferred embodiment, the polycarboxylic acids are aromatic polycarboxylic acids, such as ortho-phthalic acid, 3-nitro-phthalic acid, tetrachlorophthalic acid, mellitic acid, pyromellitic acid, or trimellitic acid and the anhydrides thereof.

Film-Forming Binders of the Thermosensitive Element

The film-forming binder of the thermosensitive element containing organic silver salts primarily comprising silver behenate, silver palmitate, or silver stearate may be any kind of natural, modified natural or synthetic resin or mixtures of such resins in which the organic silver salts may be dispersed homogeneously in either aqueous or solvent media. In a preferred embodiment, the binder may be cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene, polyethylene, or mixtures of any of the above.

A particularly suitable polyvinyl butyral containing a minor amount of vinyl alcohol units is marketed under the trade name BUTVAR™ B79 of Monsanto USA and provides a good adhesion to paper and properly subbed polyester supports.

The layer containing the organic silver salt is commonly coated onto a support in sheet or web form from an organic solvent containing the binder dissolved therein. It may also be applied from an aqueous medium containing a water-dispersible binder.

Suitable water-soluble, film-forming binders for use in thermographic and photothermographic recording materials according to the present invention include polyvinyl alcohol, polyacrylamide, polymethacrylamide, polyacrylic acid, polymethacrylic acid, polyvinylpyrrolidone, polyethyleneglycol, proteinaceous binders such as gelatin, modified gelatins such as phthaloyl gelatin, polysaccharides, such as starch, gum arabic, and dextran, and water-soluble cellulose derivatives. A preferred water-soluble binder for use in the thermographic and photothermographic recording materials of the present invention is gelatin.

Suitable water-dispersible binders for use in the thermographic and photothermographic recording materials of the present invention include any water-insoluble polymers such as: water-insoluble cellulose derivatives, polyurethanes, polyesters, polycarbonates and polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes, or mixtures of any of the above. It should be noted that there is no clear transition between a polymer dispersion and a polymer solution in the case of very small polymer particles because the smallest particles of the polymer are dissolved while those slightly larger remain in dispersion.

Preferred water-dispersible binders for use according to the present invention are water-dispersible film-forming polymers with covalently bonded ionic groups selected from the group consisting of: sulfonate, sulfinate, carboxylate, phosphate, quaternary ammonium, tertiary sulfonium, and quaternary phosphonium groups. Further preferred water-dispersible binders for use according the present invention are water-dispersible film-forming polymers with covalently bonded moieties with one or more acid groups.

Water-dispersible binders with crosslinkable groups, such as epoxy groups, aceto-acetoxy groups and crosslinkable double bonds are also preferred.

Other preferred water-dispersible binders for use in the thermographic and photothermographic recording materials of the present invention are polymer latexes. Preferably the dispersible polymer for use as a latex has some hydrophilic functionality. Polymers with hydrophilic functionality for forming an aqueous polymer dispersion (latex) are described in U.S. Pat. No. 5,006,451. However, in that patent the polymers serve to form a barrier layer preventing unwanted diffusion of vanadium pentoxide present as an antistatic agent. This use is unrelated to the use contemplated in the present invention.

Binder to Organic Silver Salt Ratio

The weight ratio of binder to organic silver salts ratio is preferably in the range of 0.2 to 6, and the thickness of the recording layer is preferably in the range of 5 to 50 $\mu$m.

Thermal Solvent

The above mentioned binders or mixtures thereof may be used in conjunction with waxes or "heat solvents" also called "thermal solvents" or "thermosolvents" to improve the reaction speed of the redox-reaction at elevated temperatures. The term "heat solvent" in this application refers to a non-hydrolyzable organic material which is in a solid state in the recording layer at temperatures below 50° C. but becomes a plasticizer for the recording layer in the heated region and/or liquid solvent for at least one of the redox-reactants, such as the reducing agent for the organic silver salts, at temperatures above 60° C.

Toning Agent

In order to obtain a neutral black image tone in the higher densities and neutral grey in the lower densities, the thermosensitive element of the present invention preferably contains a toning agent known from thermography or photothermography in thermal working relationship with the organic silver salts and reducing agents.

Suitable toning agents include the phthalimides and phthalazinones within the scope of the general formulae described in U.S. Pat. No. 4,082,901. Other useful toning agents are disclosed in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type as disclosed in GB 1,439,478, U.S. Pat. No. 3,951,660 and U.S. Pat. No. 5,599,647. A toner compound particularly suited for use in combination with polyhydroxy benzene reducing agents is 3,4-dihydro-2,4-dioxo-1,3,2H-benzoxazine, described in U.S. Pat. No. 3,951,660.

Stabilizers and Antifoggants

In order to obtain improved shelf-life and reduced fogging, stabilizers and antifoggants may be incorporated into the recording materials of the present invention. Examples of suitable stabilizers and antifoggants and their precursors, which can be used alone or in combination, include the thiazolium salts described in U.S. Pat. No. 2,131,038 and 2,694,716; the azaindenes described in U.S. Pat. No. 2,886,437 and U.S. Pat. No. 2,444,605; the urazoles described in U.S. Pat. No. 3,287,135; the sulfocatechols described in U.S. Pat. No. 3,235,652; the oximes described in GB 623,448; the thiuronium salts described in U.S. Pat. No. 3,220,839; the palladium, platinum and gold salts described in U.S. Pat. No. 2,566,263 and U.S. Pat. No. 2,597,915; the tetrazolyl-thio-compounds described in U.S. Pat. No. 3,700,457; the mesoionic 1,2,4-triazolium-3-thiolate stabilizer precursors described in U.S. Pat. No. 4,404,390 and U.S. Pat. No. 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Klosterboer, edited by J. Sturge, V. Walworth and A. Shepp, page 279, Van Nostrand (1989); in Research Disclosure 17029 published in June 1978; and in the references cited in all these documents.

Other Additives

The recording material of the present invention may contain, in addition to the ingredients mentioned above, other additives such as free fatty acids, surface-active agents, antistatic agents, such as non-ionic antistatic agents including a fluorocarbon group as in $F_3C(CF_2)_6CONH(CH_2CH_2O)$—H, silicone oil, such as BAYSILONE™ Öl A (BAYER AG, GERMANY), ultraviolet light absorbing compounds, pigments reflecting white light and/or ultraviolet radiation, and optical brightening agents.

Support

The support for the thermosensitive element according to the present invention may be transparent, translucent or opaque. For instance, it may have a white light reflecting aspect. The support is preferably a thin flexible carrier such as paper, polyethylene coated paper, or a transparent resin film, such as films made of a cellulose ester, such as cellulose triacetate, polypropylene, polycarbonate or a polyester, such as polyethylene terephthalate. In a preferred embodiment, a paper base substrate is present and may contain white light reflecting pigments: such pigments may optionally also be applied in an interlayer between the recording material and the paper base substrate.

The support may be in sheet, ribbon, or web form and may be subbed if necessary to improve adherence to the thermosensitive element. The support may be made of an opacified resin composition, such as polyethylene terephthalate opacified by means of pigments optionally in combination with micro-voids and may be optionally coated with an opaque pigment-binder layer. Such a support may be called synthetic paper or paperlike film. Information about such supports can be found in EP 194 106, EP 234 563, U.S. Pat. No. 3,944,699, U.S. Pat. No. 4,187,113, U.S. Pat. No. 4,780,402, and U.S. Pat. No. 5,059,579. Should a transparent base be used, the base may be colorless or colored, e.g. having a blue color.

One or more backing layers may be provided to control physical properties such as curl and static.

Outermost Layer

The outermost layer of the recording material may, in different embodiments of the present invention, be the outermost layer of the thermosensitive element, a protective layer applied to the thermosensitive element or a layer on the opposite side of the support to the thermosensitive element.

Protective Layer

According to a preferred embodiment of the recording material, of the present invention, the thermosensitive element is provided with a protective layer to avoid local deformation of the thermosensitive element and to improve resistance against abrasion.

The protective layer preferably comprises a binder, which may be solvent-soluble, solvent-dispersible, water-soluble or water-dispersible. Among the solvent-soluble binders polycarbonates, as described in EP-A 614 769, are particularly preferred. However, water-soluble or water-dispersible binders are preferred for the protective layer, as coating can be performed from an aqueous composition and mixing of the protective layer with the immediate underlayer can be avoided by using a solvent-soluble or solvent-dispersible binder in the immediate underlayer.

A protective layer according to the present invention may comprise in addition a thermomeltable particle optionally with a lubricant present on top of the protective layer as described in WO 94/11199. In a preferred embodiment at least one solid lubricant having a melting point below 150° C. and at least one liquid lubricant in a binder is present, wherein at least one of the lubricants is a phosphoric acid derivative.

Water-Soluble or Water-Dispersible Binder for Outermost Layer

In an embodiment of the present invention, the outermost layer of the recording material may comprise a water-soluble binder, a water-dispersible binder, or a mixture of a water-soluble and a water-dispersible binder. Suitable water-soluble binders for the outermost layer include gelatin, polyvinylalcohol, cellulose derivatives or other polysaccharides, hydroxyethyl-cellulose, and hydroxypropylcellulose, etc. Hardenable binders are preferred, with polyvinylalcohol being particularly preferred. Suitable water-dispersible binders include polymeric latexes.

Crosslinking Agents for Outermost Layer

The outermost layer of the present invention may be crosslinked. Crosslinking can be achieved using crosslinking agents such as those described in WO 95/12495 for protective layers, including tetra-alkoxysilanes, polyisocyanates, zirconates, titanates, melamine resins etc., Tetraalkoxysilanes, such as tetramethylorthosilicate and tetraethylorthosilicate, are preferred.

Matting Agents for Outermost Layer

The outermost layer of the recording material of the present invention may comprise a matting agent. Suitable matting agents are described in WO 94/11198 and include talc particles. Matting agents optionally protrude from the outermost layer.

Lubricants for Outermost Layer

Solid or liquid lubricants or combinations thereof are suitable for improving the slip characteristics of the recording materials of the present invention.

Solid lubricants may include: polyolefin waxes, ester waxes, polyolefin-polyether block copolymers, amide waxes, polyglycols, fatty acids, fatty alcohols, natural waxes and solid phosphoric acid derivatives. Preferred solid lubricants are thermomeltable particles such as those described in WO 94/11199.

Liquid lubricants may include: fatty acid esters such as glycerine trioleate, sorbitan monooleate and sorbitan trioleate, silicone oil derivatives and phosphoric acid derivatives.

Photosensitive Species

Silver halide is a preferred photosensitive species of the present invention. It is capable, upon exposure to light, of forming species capable of catalyzing reduction of the organic silver salt primarily comprising silver behenate, silver palmitate, or silver stearate of the present invention.

The photosensitive silver halide used in the present invention may be employed in a range of 0.1 to 100 mol percent of substantially light-insensitive silver salts. In a preferred embodiment, the silver halide is present in a range from 0.2 to 80 mol percent. In a more preferred embodiment it is present in a range from 0.3 to 50 mol percent. In a further more preferred embodiment, it is present in a range from 0.5 to 35 mol percent. Finally in a still further preferred embodiment, the silver halide is present in a range from 1 to 12 mol percent of substantially light-insensitive organic silver salts.

The silver halide may be any photosensitive silver halide such as silver bromide, silver iodide, silver chloride, silver bromoiodide, silver chlorobromoiodide, silver chlorobromide, etc. The silver halide may be in any form which is photosensitive including, but not limited to, cubic, orthorhombic, tabular, tetrahedral, octagonal, etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium, or iridium, etc., a reducing agent such as a tin halide, etc., or a combination thereof. The details of these procedures are described in T. H. James, "The Theory of the Photographic Process", Fourth Edition, Macmillan Publishing Co. Inc., New York (1977), Chapter 5, pages 149 to 169.

Spectral Sensitizers

The thermosensitive element, according to the present invention, may contain an infra-red sensitizer, an ultra-violet light sensitizer or a visible light sensitizer. Suitable sensitizers include cyanine, merocyanine, styryl, hemicyanine, oxonol, hemioxonol and xanthene dyes. Useful cyanine dyes include those having a basic nucleus, for example a thiazoline nucleus, an oxazoline nucleus, a pyrroline nucleus, a pyridine nucleus, an oxazole nucleus, a thiazole nucleus, a selenazole nucleus and an imidazole nucleus. Preferred merocyanine dyes include those having not only the above described basic nuclei but also acid nuclei, for example a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. Of the above described cyanine and merocyanine dyes, those having imino groups or carboxyl groups are particularly preferred.

Suitable infra-red sensitizers include those disclosed in EP-A 465 078, EP-A 559 101, EP-A 616 014, EP-A 635 756, JN 03-080251, JN 03-163440, JN 05-019432, JN 05-072662, JN 06-003763, U.S. Pat. No. 4,515,888, U.S. Pat. No. 4,639,414, U.S. Pat. No. 4,713,316, U.S. Pat. No. 5,258,282 and U.S. Pat. No. 5,441,866.

Supersensitizers

According to the present invention the thermosensitive element may further include a supersensitizer. Preferred supersensitzers are compounds selected from the group consisting of: mercapto-compounds, disulfide-compounds, stilbene compounds, organoborate compounds and styryl compounds. Suitable supersensitizers for use with infra-red spectral sensitizers are disclosed in EP-A 559 228, EP-A 587 338, U.S. Pat. No. 3,877,943, U.S. Pat. No. 4,873,184 and EP-A 821 271.

Antihalation Dyes

In addition to other ingredients, the recording materials used in the present invention may also contain antihalation or acutance dyes which absorb light which has passed through the photosensitive thermally developable photographic material, thereby preventing its reflection. Such dyes may be incorporated into the photosensitive thermally developable photographic material or in any other layer of the photographic material of the present invention.

Antistatic Layer

In a preferred embodiment of the recording material of the present invention an antistatic layer is applied to the outermost layer not comprising at least one solid lubricant having a melting point below 150° C. and at least one liquid lubricant in a binder, wherein at least one of the lubricants is a phosphoric acid derivative.

Coating

The coating of any layer of the recording material of the present invention may proceed by any coating technique, e.g. such as described in Modern Coating and Drying Technology, edited by Edward D. Cohen and Edgar B. Gutoff, (1992) VCH Publishers Inc., New York, U.S.A.

Thermographic Processing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, with a thermographic material preferably containing an infra-red absorbing compound, or by direct thermal imaging with a thermal head.

In thermal printing, image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in color development takes place. Such thermal printing heads may be used in contact or close proximity with the recording material. The operating temperature of common thermal printheads is in the range of 300 to 400° C. and the heating time per picture element (pixel) may be less than 1.0 ms, the pressure contact of the thermal printhead with the recording material being, e.g., 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet which prevents transfer of recording material during heating.

The image signals for modulating the laser beam or current in the micro-resistors of a thermal printhead are obtained directly, for example, from opto-electronic scanning devices. They may also be obtained from an intermediary storage means such as a magnetic disc or tape or optical disc storage medium. Optionally, these intermediary means may be linked to a digital image work station where the image information can be processed to satisfy particular needs.

Activation of the heating elements can be power-modulated or pulse-length modulated at constant power. The image-wise heating can be carried out such that heating elements not required to produce an image pixel generate an amount of heat ($H_e$) in accordance with the following formula:

$$0.5\ H_D<H_e<HD$$

wherein $H_D$ represents the minimum amount of heat required to cause visible image formation in the recording material.

EP-A 654 355 discloses a method for making an image by image-wise heating with a thermal head having energizable heating elements. The activation of the heating elements is executed duty cycled pulsewise. When used in thermographic recording operating with thermal printheads, the thermographic recording materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound, using, for example an ultrasonic pixel printer as described e.g. in U.S. Pat. No. 4,908,631.

Photothermographic Processing

Photothermographic recording materials, according to the present invention, may be exposed with radiation of wavelength between an X-ray wavelength and a 5 microns wavelength. The image may be obtained by pixel-wise exposure with: a finely focused light source, such as a CRT light source; a UV, visible or IR wavelength laser, such as a He/Ne-laser or an IR-laser diode, e.g. emitting at 780 nm, 830 nm or 850 nm; a light emitting diode, for example one emitting at 659 nm; or by direct exposure to the object itself or an image therefrom with appropriate illumination e.g. with UV, visible or IR light.

For the thermal development of image-wise exposed photothermographic recording materials, according to the present invention, any sort of heat source can be used that enables the recording materials to be uniformly heated to the development temperature in a time acceptable for the application concerned. Contact heating, radiative heating, microwave heating, etc. may be used.

Industrial Application

Direct thermal imaging and photothermographic imaging can be used for the production of transparencies and for reflection type prints. Application of the present invention is envisaged in the fields of both graphics images requiring high contrast images with a very steep dependence of print density upon applied dot energy and of continuous tone images requiring a weaker dependence of print density upon applied dot energy, such as required in the medical diagnostic field. In the hard copy field, recording materials on a white opaque base are used, whereas in the medical diagnostic field black-imaged transparencies are widely used in inspection techniques operating with a light box.

The invention is illustrated hereinafter by way of invention examples and comparative examples.

It will be understood by one skilled in the art that examples given only for organic silver salts primarily comprising silver behenate, silver palmitate or silver stearate might be adapted, in light of this disclosure, for application to the other two carboxylic acids of the group or other carboxylic acids in general. The same is true for techniques and materials described above which may be omitted in the examples. Commercially available forms of behenic, palmitic, and stearic acids may be used, each of which tend to contain at least trace amounts of all three of these acids, as well as other carboxylic acids. Therefore, this disclosure also teaches one skilled in the art to obtain particles of any carboxylic acids commonly found in commercially available behenic, palmitic, or stearic acids. Specially prepared and relatively pure forms of the these and other carboxylic acids may also be employed in the disclosed process.

The percentages and ratios given in these examples are by weight unless otherwise indicated. The ingredients used in the invention and comparative examples, other than those mentioned above, are:

as organic silver salt:

AgB=silver behenate;

Ag Pa=silver palmitate;

AgSt=silver stearate;

as binders:

PVB=BUTVAR™ B79, a polyvinyl butyral from Monsanto;

K7598=type K7598, a calcium-free gelatin from AGFA-GEVAERT GELATINEFABRIEK vorm, KOEPFF & SÖHNE;

K17881=type K17881, a calcium-free gelatin from AGFA-GEVAERT GELATINEFABRIEK vorm. KOEPFF & SÖHNE;

K16353=type K16353, a calcium-free high viscosity gelatin from AGFA-GEVAERT GELATINEFABRIEK vorm. KOEPFF & SÖHNE;

LATEX 01=a latex of a copolymer of 50% by weight of butadiene and 50% by weight of methyl methacrylate;

LATEX 02=a latex of a terpolymer of 47.5% by weight of butadiene, 47.5% by weight of methyl methacrylate and 5% by weight of itaconic acid;

LATEX 03=a 24% by weight aqueous latex of a polymer produced by copolymerizing a monomer mixture comprising 42% by weight of n-butyl acrylate, 53% by weight of styrene, 2% by weight of itaconic acid and 3% by weight of $CH_2{=}C(CH_3)CONH{-}(CH_2)_{10}{-}CONHC_6H_4\text{-}p{-}SO_3K$ followed by desalting and adjusting to pH 5.4 with ammonia;

as reducing agents:

R01=ethyl 3,4-dihydroxybenzoate;

R02=3(3',4'-dihydroxyphenyl)propionic acid;

R03=LOWINOX™ 22IB46, 2-propyl-bis(2-hydroxy-3,5-dimethylphenyl) from CHEM. WERKE LOWI;

as toning agents:

TA01=benzo[e][1,3]oxazine-2,4-dione;

TA02=7-(ethylcarbonato)-benzo[e][1,3]oxazine-2,4-dione (see formula I below)

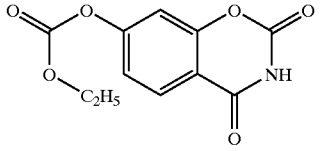

(I)

TA03=succinimide;

TA04=phthalazinone;

TA05=phthalazine;

as levelling agent:

oil=Baysilone™, a silicone oil from Bayer AG;

as stabilizers:

S01=tetrachlorophthalic anhydride;

S02=adipic acid;

S03=benzotriazole.

INVENTION EXAMPLES AND COMPARATIVE EXAMPLES COMPRISING SILVER BEHENATE

Preparation of Silver Behenate

The silver behenate types A to C of COMPARATIVE EXAMPLES 1 to 3 and silver behenate types I to VII of INVENTION EXAMPLES 1 to 7 were prepared by dissolving the required quantity of behenic acid in 2-butanone at 60° C. with vigorous stirring followed by adding demineralized water while maintaining the reactor at a temperature of between 56 and 60° C. The behenic acid was then converted into sodium behenate, in the quantity and at the concentration specified in Tables 1 and 2 for the COMPARATIVE and INVENTION EXAMPLES respectively, by adding an aqueous solution of sodium hydroxide with vigorous stirring while maintaining the temperature of the reactor at a temperature between 56° and 60° C. The sodium behenate is then converted into silver behenate by adding the quantity of silver nitrate specified for the specific EXAMPLE and silver behenate type in Tables 1 and 2 for the COMPARATIVE and INVENTION EXAMPLES respectively as an aqueous solution with vigorous stirring. The rate of addition is specified for the specific EXAMPLE and silver behenate type in Tables 1 and 2 for the COMPARATIVE and INVENTION EXAMPLES, respectively. The reactor temperature was maintained during silver nitrate addition at the temperature given for the specific EXAMPLE and silver behenate type in Tables 1 and 2 for the COMPARATIVE and INVENTION EXAMPLES, respectively. The final percentage by weight of 2-butanone in the suspending mixture of 2-butonone and water and the initial mixing number for the specific EXAMPLE and silver behenate type are also given in Tables 1 and 2 for the COMPARATIVE and INVENTION EXAMPLES respectively.

TABLE 1

| Comparative example number | AgB type | sodium behenate quantity [moles] | sodium behenate concentration* [M] | silver nitrate quantity [moles] | silver nitrate concentration [M] | final % by weight 2-butanone | temperature [° C.] | $AgNO_3$ addition time [min] | initial mixing number $MN_0$ |
|---|---|---|---|---|---|---|---|---|---|
| 1 | A | 180 | 0.248 | 180 | 0.4 | 23 | 65 | 240 | $9.5 \times 10^{-5}$ |
| 2 | B | 180 | 0.248 | 180 | 0.4 | 23 | 65 | 240 | $9.5 \times 10^{-5}$ |
| 3 | C | 180 | 0.248 | 180 | 0.4 | 23 | 65 | 240 | $9.5 \times 10^{-5}$ |

*initial concentration

TABLE 2

| Invention Example number | AgB type | sodium behenate quantity [moles] | sodium behenate concentration* [M] | silver nitrate quantity [moles] | silver nitrate concentration [M] | final % by weight 2-butanone | temperature [° C.] | $AgNO_3$ addition time [min] | initial mixing number $MN_0$ |
|---|---|---|---|---|---|---|---|---|---|
| 1 | I | 0.245 | 0.097 | 0.245 | 1.75 | 45 | 55 | $3^+ + 55^X$ | $1.09 \times 10^{-3}$ |
| 2 | II | 110.9 | 0.100 | 110.9 | 1.67 | 45 | 55 | $3^+ + 15^X$ | $5.29 \times 10^{-3}$ |
| 3 | III | 0.25 | 0.183 | 0.25 | 1.88 | 45 | 60 | 0.75 | $4.73 \times 10^{-3}$ |
| 4 | IV | 151.4 | 0.194 | 151.4 | 5.91 | 45 | 55 | 1.5 | $1.60 \times 10^{-2}$ |
| 5 | V | 0.5 | 0.158 | 0.5 | 3.76 | 45 | 55 | $1.5^+ + 11^X$ | $2.74 \times 10^{-3}$ |
| 6 | VI | 98 | 0.087 | 98 | 5.91 | 45 | 55 | 1.08 | $2.92 \times 10^{-2}$ |
| 7 | VII | 3.066 | 0.085 | 3.066 | 1.67 | 40 | 55 | 119 | $2.20 \times 10^{-4}$ |

*initial concentration
+first half of $AgNO_3$
Xsecond half of $AgNO^3$

Dispersions of Silver Behenate in 2-Butanone

The dispersions of COMPARATIVE EXAMPLE 4, COMPARATIVE EXAMPLE 5 and INVENTION EXAMPLE 9 were obtained by ball milling for 120 hours 56.5 g of the dried silver behenate powders of COMPARATIVE EXAMPLE 1, COMPARATIVE EXAMPLE 2 and INVENTION EXAMPLE 1, respectively, in a solution of 56.5 g of PVB in 387.5 g of 2-butanone.

The dispersions of COMPARATIVE EXAMPLE 6 and INVENTION EXAMPLES 8 and 10 to 15 were obtained by first preparing a predispersion of 56.5 g of the dried silver behenate powders of COMPARATIVE EXAMPLE 3 and INVENTION EXAMPLES 1 to 7, as given below in Tables 3 and 4, in a solution of 56.5 g of PVB in 387.5 g of 2-butanone by stirring for 10 minutes with an Ultra-Turrax™ stirrer. These predispersions were then microfluidized by passing them once through a MICROFLUIDICS™ M-110Y high pressure microfluidizer at a jet pressure of 400 bar to produce the dispersions of COMPARATIVE EXAMPLE 6 and INVENTION EXAMPLES 8 and 10 to 15.

Coating of Recording Materials

A subbed polyethylene terephthalate support having a thickness of 175 $\mu$m was doctor blade-coated from a coating composition containing 2-butanone as a solvent using the above-described silver behenate dispersions and the additional ingredients given below so as to obtain thereon, after drying for 1 hour at 50° C., layers with the compositions given in Table 3 for COMPARATIVE EXAMPLES 4 to 6 with silver behenate types A to C respectively, prepared according to COMPARATIVE EXAMPLES 1 to 3 respectively, and those given in Table 4 for INVENTION EXAMPLES 8 to 15 with silver behenate types I to VII as indicated therein, prepared according to INVENTION EXAMPLES 1 to 7.

Determination of the Crystallinity of Silver Behenate in the Recording Materials The crystallinity of the silver behenate in the recording materials of the recording materials of COMPARATIVE EXAMPLES 4 to 6 and INVENTION EXAMPLES 8 to 15 were determined as follows:

i) 30 mm diameter samples of the recording materials of COMPARATIVE EXAMPLES 4 to 6 and INVENTION EXAMPLES 8 to 15 and of NIST standard 1976 were cut from larger sheets using a punch;

ii) X-ray diffraction scans were then carried out using a SEMENS D5000 X-ray diffractometer equipped with a copper $K\alpha_1$ X-ray source operating at 40 keV and a current of 30 mA with the samples in the sample holder thereof to scan the samples of COMPARATIVE EXAMPLES 4 to 6, INVENTION EXAMPLES 8 to 15 and NIST standard 1976, with the same X-ray diffractometer in exactly the same state of adjustment, in steps of 0.05 degrees at a rate of 1 step/s between Bragg angles, 2Θ of 5° and 50° and the data processed using SIEMENS DIFFRAC™ AT software to produce X-ray diffraction spectra corrected for background and exact peak heights of each X-ray diffraction peak. Five X-ray scans were carried out for each sample, with the data being processed separately as described above, and average peak heights calculated for each X-ray diffraction peak;

iii) the $K_{material}$ values were then determined for the recording materials of COMPARATIVE EXAMPLES 4 to 6 and INVENTION EXAMPLES 8 to 15 by adding up the average peak heights of the X-ray diffraction lines attributable to silver behenate at Bragg angles, 2Θ, of 6.01°, 7.56°, 9.12°, 10.66°, 12.12° and 13.62°;

iv) the $K_{1976}$ value was determined for NIST standard 1976 by adding up the average peak heights of the X-ray diffraction lines at Bragg angles, 2Θ, of 25.60°, 35.16° and 43.40°;

v) the weights of silver, $C_{Ag}$, present in 1 $m^2$ of the recording materials of COMPARATIVE EXAMPLES 4 to 6 and INVENTION EXAMPLES 8 to 15 were determined using a PHILIPS PW2400 wavelength dispersive X-ray fluorescence apparatus with a copper $K_\alpha$ X-ray source operating at 60 keV and a current of 50 mA, which had been calibrated for silver using silver-containing samples for which the silver concentrations had been determined using standard volumetric titration techniques; and vi) the crystallinity values for the silver behenate present in the recording materials of COMPARATIVE EXAMPLES 4 to 6 and INVENTION EXAMPLES 8 to 15 were determined using the expression: $K_{material}/(K_{1976} \times C_{Ag})$.

The crystallinity values for the silver behenate present in the recording materials of COMPARATIVE EXAMPLES 4 to 6 and INVENTION EXAMPLES 8 to 15 are summarized in Tables 3 and 4 respectively.

TABLE 3

| Compar-Ative example nr | silver behenate Type | Crystal-linity [m²/g] | [g/m²] | PVB [g/m²] | R01 [g/m²] | TA01 [g/m²] | TA02 [g/m²] | Oil [g/m²] | S01 [g/m²] | S02 [g/m²] | S03 [g/m²] |
|---|---|---|---|---|---|---|---|---|---|---|---|
| 4 | A | 0.71 | 5.426 | 21.70 | 1.111 | 0.297 | 0.152 | 0.048 | 0.173 | 0.390 | 0.144 |
| 5 | B | 0.72 | 5.277 | 21.11 | 1.080 | 0.289 | 0.148 | 0.047 | 0.169 | 0.379 | 0.140 |
| 6 | C | 0.65 | 5.953 | 23.81 | 1.218 | 0.326 | 0.167 | 0.053 | 0.191 | 0.427 | 0.158 |

TABLE 4

| Invention example nr | silver behenate Type | crystal-linity [m²/g] | [g/m²] | PVB [g/m²] | R01 [g/m²] | TA01 [g/m²] | TA02 [g/m²] | Oil [g/m²] | S01 [g/m²] | S02 [g/m²] | S03 [g/m²] |
|---|---|---|---|---|---|---|---|---|---|---|---|
| 8 | I | 1.57 | 4.978 | 19.91 | 1.019 | 0.272 | 0.140 | 0.045 | 0.159 | 0.357 | 0.133 |
| 9 | I | 1.04 | 5.136 | 20.54 | 1.051 | 0.281 | 0.144 | 0.046 | 0.164 | 0.369 | 0.137 |
| 10 | II | 1.54 | 5.031 | 20.12 | 1.030 | 0.275 | 0.141 | 0.045 | 0.161 | 0.361 | 0.134 |
| 11 | III | 1.42 | 4.820 | 19.28 | 0.987 | 0.264 | 0.135 | 0.043 | 0.154 | 0.346 | 0.128 |
| 12 | IV | 1.68 | 4.978 | 19.91 | 1.019 | 0.264 | 0.140 | 0.045 | 0.159 | 0.357 | 0.133 |
| 13 | V | 1.68 | 4.899 | 19.60 | 1.003 | 0.268 | 0.138 | 0.044 | 0.157 | 0.352 | 0.130 |
| 14 | VI | 1.00 | 4.820 | 19.28 | 0.987 | 0.264 | 0.135 | 0.043 | 0.154 | 0.346 | 0.128 |
| 15 | VII | 1.58 | 5.479 | 21.92 | 1.121 | 0.300 | 0.154 | 0.049 | 0.175 | 0.447 | 0.146 |

Thermographic Printing

The printer was equipped with a thin film thermal head with a resolution of 300 dpi and was operated with a line time of 19 ms (the line time being the time needed for printing one line). During the line time the print head received constant power. The average printing power, being the total amount of electrical input energy during one line time divided by the line time and by the surface area of the heat-generating resistors, was 1.5 mJ/dot being sufficient to obtain maximum optical density in each of the recording materials. During printing the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving the ribbon with a total thickness of 6 μm.

Image Evaluation

The optical maximum and minimum densities of the prints obtained with the recording materials of COMPARATIVE EXAMPLES 4 to 6 and INVENTION EXAMPLES 8 to 15 measured through a visual filter with a MacBeth™ TR924 densitometer for grey scale steps corresponding to data levels of 255 and 0 respectively are given in Tables 5 and 6.

Image Tone Assessment

The image tone was determined by first printing recording materials which had been tempered for 7 days at 45° C. as described above and then subjecting the prints to visual inspection and to measurement of the b* CIELAB-value of the image as a function of image density as determined with a MacBeth™ TR924 densitometer. The L*, a* and b* CIELAB-values were determined by spectrophotometric measurements according to ASTM Norm E179-90 in a R(45/0) geometry with evaluation according to ASTM Norm E308-90. The visually assessed image tone and the b* value at the minimum in the dependence of b* upon image density for the recording materials of COMPARATIVE EXAMPLES 4 to 6 and INVENTION EXAMPLES 8 to 15 are also summarized in Tables 5 and 6 respectively.

TABLE 5

| Comparative example number | AgB type | print characteristics $D_{max}$ | $D_{min}$ | image tone from visual inspection | b* at minimum in b* vs OD |
|---|---|---|---|---|---|
| 4 | A | 3.39 | 0.07 | brown | −0.1 |
| 5 | B | 3.48 | 0.07 | brown | −0.4 |
| 6 | C | 2.84 | 0.09 | brown | −1.5 |

TABLE 6

| Invention example number | AgB type | print characteristics $D_{max}$ | $D_{min}$ | image tone from visual inspection | b* at minimum in b* vs OD |
|---|---|---|---|---|---|
| 8 | I | 3.21 | 0.07 | blue | −4.3 |
| 9 | I | 2.82 | 0.07 | blue | −3.4 |
| 10 | II | 3.13 | 0.07 | blue/red | −4.8 |
| 11 | III | 2.81 | 0.07 | blue | −4.0 |
| 12 | IV | 2.81 | 0.07 | blue | −3.3 |
| 13 | V | 3.32 | 0.07 | blue/red | −3.0 |
| 14 | VI | 2.57 | 0.07 | blue | −3.7 |
| 15 | VII | 2.86 | 0.08 | blue | −5.1 |

The recording materials of COMPARATIVE EXAMPLES 4 to 6 with silver behenate types A to C all exhibited prints with a brown tone and a b* value at the minimum in the b* dependence upon image density of greater than −2.0, whereas the recording materials of INVENTION EXAMPLES 8 to 15 with silver behenate types I to VII prepared according to the present invention exhibited prints with a blue or blue/red tone and a b* value at the minimum in the b* dependence upon image density of less than −2.0.

The crystallinity and visual tone of silver behenate in samples of THERMALRES™ FILM type PR-PM-film lot number 04673456 a thermographic recording material based on a silver behenate-reducing-agent system from LABELON, COMPARATIVE EXAMPLE 7, and of DRYVIEW™ 39701 DVB (blue) lot number 021132-013-A-025 a photothermographic recording material based on a silver behenate-reducing agent system from NATION, COMPARATIVE EXAMPLE 8, was determined as described for INVENTION EXAMPLES 8 to 15 and COMPARATIVE EXAMPLES 4 to 6 and the results are summarized in Table 7. Visual inspection of the silver behenate in the case of DRYVIEW™ 39701 DVB (blue) is not possible due to the use of a blue support.

TABLE 7

| Comparative Example number | Recording material | Crystallinity [$m^2/g$] | image tone from visual inspection |
|---|---|---|---|
| 7 | THERMALRES ™ PR-PM-Film | 0.46 | brown |
| 8 | DRYVIEW ™ 39701 (blue) | 0.50 | not possible |

Thermographic Recording Material Incorporating Silver Behenate Produced According to the Teaching of EP-A 754 969

A sodium behenate solution was prepared by first dissolving 34 kg of behenic acid in 340L of 2-propanol at 65° C. and then adding with stirring a 0.25N solution of sodium hydroxide until a solution pH of 8.7 was obtained. This required about 400L of 0.25N NaOH. The concentration of the resulting solution was then adjusted to a sodium behenate concentration of 8.9% by weight and a concentration of 2-propanol in the solvent mixture of 16.7% by volume, by a combination of evaporation and dilution.

The silver behenate synthesis was carried out at a constant UAg of 400 mV as follows: to a stirred solution of 30 g of gelatin (type 7598 from AGFA GELATINFABRIK vorm. KOEPFF & SOEHNE) in 750 mL of distilled water at 72° C. in a double walled reactor, several drops of a 2.94M aqueous solution of silver nitrate were added to adjust the UAg at the start of the reaction to 400 mV and then 374 mL of the sodium behenate solution, whose preparation is described above, at a temperature of 78° C. was metered into the reactor at a rate of 46.6 mL/min and simultaneously a 2.94M aqueous solution of silver nitrate was metered into the reactor, its addition rate being controlled by the quantity of the silver nitrate solution necessary to maintain a UAg of 400±5 mV in the dispersing medium in the reactor. Both the sodium behenate and silver nitrate solutions were added to the dispersing medium via small diameter tubes positioned just under the surface of the dispersing medium. By the end of the addition step 0.092 moles of sodium behenate and 0.101 moles of silver nitrate had been added. The mixture was then stirred for a further 30 minutes. The resulting silver behenate dispersion contained 3.13% by weight of silver behenate and 2,28% by weight of K7598.

0.032 g of TA03, 2 g of a 20% by weight aqueous dispersion of LATEX 01 and tenside were added with stirring to 15 g of this silver behenate dispersion and the resulting dispersion diluted with demineralized water to a weight of 18.8 g before coating at a temperature of 40° C., using a doctor blade coater with a slit-width of 120 $\mu$m, onto a subbed 100 $\mu$m thick polyester sheet and dried. The dried layer consisted of: ca. 3 $g/m^2$ silver behenate, ca. 2.5 $g/m^2$ of LATEX 01, ca. 2.2 $g/m^2$ of K7598 and ca. 0.2 $g/m^2$ of TA03.

The crystallinity of the silver behenate in the thermographic material was determined as described for INVENTION EXAMPLES 8 to 15 and COMPARATIVE EXAMPLES 4 to 6 to be 0.33 $m^2/g$.

Preparation of Silver Behenate Dispersions in an Aqueous Medium in the Absence of Organic Solvent Using a Single Jet Process Aqueous dispersions of the silver behenate types VIII to XII of INVENTION EXAMPLES 16 to 20 were produced as follows:

i) dispersing 102.18 g (0.3M) behenic acid with stirring at 400 rpm with a 100 mm diameter typhoon stirrer in a 250 mm in diameter vessel at 80° C. in a quantity of mL of a 10% solution of Surfactant nr 1/g behenic acid (see table 8) made up to 1L with deionized water at a temperature of 80° C.;

ii) then adding 150 mL of a 2M aqueous solution of sodium hydroxide with stirring at 400 rpm with a 100 mm diameter typhoon stirrer to the 250 mm in diameter vessel at 80° C. over a period of 10 to 20 minutes to clear solution substantially containing sodium behenate;

iii) then adding a 300 mL of a 1M (or 100 mL of 3M in cases of INVENTION EXAMPLES 17 & 18) aqueous solution of silver nitrate with stirring at 400 rpm with a 100 mm diameter typhoon stirrer to the 250 mm in diameter vessel at a temperature of 80° C. at a particular rate of moles/(moles silver behenate×min) (see Table 8 for the value for the particular silver behenate type), to convert the sodium behenate completely into silver behenate; and iv) ultrafiltration with a 500000 MW polysulfone cartridge filter at room temperature to concentrate the resulting silver behenate dispersion (final AgB-concentration and residual conductivity in mS/cm are given in Table 8).

The volume average particle size as determined by a Coulter LS230 diffractometer is en in table 8.

TABLE 8

| Invention Example number | AgB type | Surfactant type | Surfactant mL 10% sol./g HBeh | Temperature [° C.] | mol $AgNO_3$ /(mol AgB × min) | Ultrafiltration residual conductivity [mS/cm] | Ultrafiltration % AgB dispersion | average particle size [μm] |
|---|---|---|---|---|---|---|---|---|
| 16 | VIII | nr 1 | 2.28 | 80 | 0.0625 | 4.9 | 23.3 | 0.433 |
| 17 | IX | nr 1 | 2.28 | 80 | 0.0625 | 4.3 | 18.9 | |
| 18 | X | nr 1 | 2.28 | 80 | 2.25 | | 14.11 | 0.111 |
| 19 | XI | nr 1 | 4.56 | 80 | 0.0625 | 6.2 | 14.0 | 0.187 |
| 20 | XII | nr 1 | 4.56 | 80 | 0.157 | 6.5 | 14.0 | 0.135 |

These dispersions of silver behenate were directly used in the preparation of thermographic recording materials comprising thermographic elements coated from aqueous media.

Toning Agent Dispersions toner dispersion 01: dispersion of TA01 in an aqueous solution of Surfactant Nr 1 containing 30% of TA01 and 3% of Surfactant Nr. 1 (added as a dispersion);

toner dispersion 02: dispersion of TA02 in a gelatin solution containing 20% of K7598 (gelatin) and 10% of TA02 (added as flakes).

Preparation of Thermographic Recording Materials with the Aqueous Silver Behenate-Dispersions The thermographic recording materials of INVENTION EXAMPLES 16 to 20 were prepared by first dissolving K7598 in deionized water at 36° C. (see Table 9 for quantities), then adding the appropriate Surfactant Nr 1-containing silver behenate emulsion (see Table 9 for quantity and concentration), then an aqueous dispersion of LATEX 02 with a pH of 5.0 (for quantity see Table 9) followed by 5 minutes stirring, then an aqueous toner dispersion (for number and quantity, see Table 9), while keeping the dispersion at 36° C. followed by vigorous stirring, then 6.3 g of toner dispersion 02 (see INVENTION EXAMPLES 16 to 20), then 11.23 g of a 13.7% by weight solution of R01 in ethanol and finally 1.31 g of a 3.66% by weight aqueous solution of formaldehyde.

TABLE 9

| Invention Example nr | water [g] | K7598 [g] | AgB disp. conc [%] | AgB disp. wt. [g] | Polymer 1 conc [%] | Polymer 1 wt. [g] | toner disp. nr | toner disp. wt. [g] |
|---|---|---|---|---|---|---|---|---|
| 16 | 22.66 | 2.25 | 23.25 | 19.36 | 30 | 5.58 | 01 | 3.61 |
| 17 | 10.58 | 2.26 | 18.9 | 23.68 | 30 | 5.57 | 02 | 5.38 |
| 18 | 10.12 | 2.25 | 14.11 | 31.90 | 30 | 5.58 | 01 | 3.61 |
| 19 | 9.90 | 2.25 | 14.0 | 32.13 | 30 | 5.58 | 01 | 3.61 |
| 20 | 9.82 | 2.25 | 14.0 | 32.20 | 30 | 5.58 | 01 | 3.61 |

The resulting silver behenate emulsions were then doctor blade-coated onto a 175 μm thick subbed polyethylene terephthalate support to produce the coating weights of silver given in Table 10.

The crystallinity of the silver behenate in the thermographic recording materials of INVENTION EXAMPLES 16 to 20 were determined as described for INVENTION EXAMPLES 8 to 15 and COMPARATIVE EXAMPLES 4 to 6 and are given in Table 10.

The thermographic recording materials of INVENTION EXAMPLES 16 to 20 and COMPARATIVE EXAMPLE 7 were printed and the prints evaluated as described for INVENTION EXAMPLES 8 to 15 and COMPARATIVE EXAMPLES 4 to 6. The maximum and minimum densities of the prints obtained with the thermographic recording materials of INVENTION EXAMPLES 16 to 20 measured through a blue filter with a MacBeth™ TR924 densitometer for grey scale steps corresponding to data levels of 255 and 0 respectively are also given in Table 10.

Archivability Test

The achivability of prints made with the thermographic recording materials of INVENTION EXAMPLES 16 to 20 and COMPARATIVE EXAMPLE 7 was evaluated on the basis of the observed changes in minimum density upon heating the prints at 57° C. in a relative humidity (RH) of 34% for 3 days in the dark. The results of these tests are given in Table 10.

Light Box Test

The stability of the image background of the prints made with the thermographic recording materials of INVENTION EXAMPLES 16 to 20 and COMPARATIVE EXAMPLE 7 was evaluated on the basis of the change in minimum (background) density measured through a blue filter using a MacBeth™ TR924 densitometer upon exposure on top of the white PVC window of a specially constructed light-box placed for 3 days in a Votsch conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested.

The results of the light box tests are also given in Table 10.

The silver behenate in the thermographic recording materials of INVENTION EXAMPLES 16 to 20 exhibit high to very high crystallinities, according to the present invention, and the thermographic recording materials with these silver behenate particles with high to very high crystallinity exhibit minimum densities which are hardly changed upon being subjected to archivability and light box tests.

TABLE 10

| Comparative Example number | Silver behenate type | coating wt. [g/m²] | crystallinity [m²g] | fresh print characteristics $D_{max}$ (blue) | $D_{min}$ (blue) | $\Delta D_{min}$(blue) archivability (3d/57° C./34% RH) | $\Delta D_{min}$(blue) light box (3d/30° C./85% RH) |
|---|---|---|---|---|---|---|---|
| 7 | | | 0.46 | >4.0 | 0.10 | +0.83 | +0.02 |
| Invention example nr | | | | | | | |
| 16 | VIII | 2.86 | 5.39 | 4.41 | 0.14 | −0.01 | 0.03 |
| 17 | IX | 3.98 | 1.76 | 3.56 | 0.11 | +0.01 | 0.04 |
| 18 | X | 3.61 | 3.20 | 3.27 | 0.12 | −0.03 | −0.01 |
| 19 | XI | 3.82 | 7.30 | 3.02 | 0.11 | −0.01 | 0.00 |
| 20 | XII | 4.19 | 1.92 | 3.16 | 0.13 | −0.02 | −0.01 |

The photothermographic recording material of INVENTION EXAMPLE 21 was produced using a silver behenate dispersion prepared by first preparing a predispersion by adding 56.5 g of the dried silver behenate powder type II of INVENTION EXAMPLE 2 to a solution of 56.6 g PVB in 413.1 g of 2-butanone and then stirring for 10 minutes with an Ultra-Turrax™ stirrer. This predispersion was then microfluidized by passing it once through a MICROFLUIDICS™ M-110Y high pressure microfluidizer at a jet pressure of 400 bar to produce a 10.74% by weight dispersion of silver behenate in 2-butanone.

A photothermographic coating dispersion was then obtained by mixing 43.326 g of the silver behenate dispersion with 48.959 g of a 30% by weight solution of PVB for 20 minutes, 0.145 g of potassium iodide followed by 15 minutes stirring, 0.934 g of a 2-butanone solution containing 30% by weight of TA01 and 15.4% by weight of TA02 followed by 20 minutes stirring, 0.441 g of a 10% by weight solution of Oil in 2-butanone followed by 20 minutes stirring and 0.351 g of S02 followed by 20 minutes stirring. To this dispersion was then added with stirring a solution of 0.997 g of R01, 0.078 g of S01 and 0.130 g of S03. The resulting coating dispersion was then doctor blade-coated to a wet thickness of 120 μm onto a subbed polyethylene terephthalate support having a thickness of 175 μm to obtain, after drying for 1 hour at 50° C., a photothermographic recording material with a silver behenate coating weight of 4.31 g/m² and a silver iodide coating weight of 0.19 g/m².

The crystallinity of the silver behenate in the photothermographic recording materials of INVENTION EXAMPLE 21 was determined as described for INVENTION EXAMPLES 8 to 15 and COMPARATIVE EXAMPLES 4 to 6 to be 1.16 m²/g.

The photothermographic recording material INVENTION EXAMPLE 21 was then exposed to ultra-violet light through a test original in contact with the material in an Agfa-Gevaert™ DL 1000 exposure apparatus followed by heating on a heated metal block for 5 s at 100° C. to produce a good image.

The photothermographic recording material of INVENTION EXAMPLE 22 was produced using a silver behenate dispersion prepared as described in INVENTION EXAMPLE 20 for silver behenate type XII except that no ultrafiltration was carried out and that the concentration of silver behenate in the dispersion was 8.15% by weight instead of 14.0% by weight.

A photothermographic coating dispersion was then obtained by mixing with stirring 7.5 g of the silver behenate dispersion with 4 g of an 0.44% by weight aqueous solution of potassium iodide, then 2 g of a 20% by weight aqueous dispersion of LATEX 02, then 0.64 g of a 5.6% by weight aqueous solution of phthalazine and finally with 2 g of a 5.6% by weight aqueous solution of R02. The resulting coating dispersion was then doctor blade-coated to a wet thickness of 120 μm onto a subbed polyethylene terephthalate support having a thickness of 100 μm to obtain, after drying for 1 hour at 50° C., a photothermographic recording material with a silver behenate coating weight of 3.28 g/m² and a silver iodide coating weight of 0.12 g/m².

The crystallinity of the silver behenate in the photothermographic recording materials of INVENTION EXAMPLE 22 was determined as described for INVENTION EXAMPLES 8 to 15 and COMPARATIVE EXAMPLES 4 to 6 to be 1.10 m²/g.

The photothermographic recording material of INVENTION EXAMPLE 22 was then exposed to ultra-violet light through a test original in contact with the material in an Agfa-Gevaert™ DL 1000 exposure apparatus followed by heating on a heated metal block for 5 s at 100° C. to produce a very good image with a high contrast.

The photothermographic recording material of INVENTION EXAMPLE 23 was produced using the silver behenate dispersion described in INVENTION EXAMPLE 22. A photothermographic coating dispersion was then obtained as described for INVENTION EXAMPLE 22 except that 4 g of 0.97% by weight aqueous solution of calcium iodide was used instead of 4 g of an 0.44% by weight aqueous solution of potassium iodide. The resulting coating dispersion was then doctor blade-coated to a wet thickness of 120 μm onto a subbed polyethylene terephthalate support having a thickness of 100 μm to obtain, after drying for 1 hour at 50° C., a photothermographic recording material with a silver behenate coating weight of 3.17 g/m² and a silver iodide coating weight of 0.11 g/m².

The crystallinity of the silver behenate in the photothermographic recording materials of INVENTION EXAMPLE 23 was determined as described for INVENTION EXAMPLES 8 to 15 and COMPARATIVE EXAMPLES 4 to 6 to be 1.22 $m^2/g$.

The photothermographic recording material INVENTION EXAMPLE 23 was then exposed and thermally developed as described above for INVENTION EXAMPLE 22 to produce a very good image with a high contrast.

Enhancement of Silver Behenate Crystallinity in the Presence of Phosphonium Compounds The thermographic recording materials of INVENTION EXAMPLES 24 to 26 had a composition which differed from that of INVENTION EXAMPLE 10. Therefore, since the composition has an influence upon the image color, the print characteristics of INVENTION EXAMPLES 24 to 26 are not directly comparable with that of INVENTION EXAMPLE 10.

The thermographic recording materials of INVENTION EXAMPLES 24 to 26 were produced using a silver behenate dispersion prepared by first preparing a predispersion by adding 56.5 g of the dried silver behenate powder type II of INVENTION EXAMPLE 2 to a solution of 56.5 g of PVB in 413.1 g of 2-butanone and then stirring for 10 minutes with an Ultra-Turrax™ stirrer. This predispersion was then microfluidized by passing it once through a MICROFLUIDICS™ M-110Y high pressure microfluidizer at a jet pressure of 400 bar to produce a 10.74% by weight dispersion of silver behenate in 2-butanone.

Coating of Recording-Materials

A subbed polyethylene terephthalate support having a thickness of 175 $\mu$m was doctor blade-coated from a coating composition containing 2-butanone as a solvent using the above-described silver behenate dispersions and the additional ingredients given below so as to obtain thereon, after drying for 1 hour at 50° C., layers with the compositions given in Table 11 for the thermographic recording materials of INVENTION EXAMPLES 24 to 26.

TABLE 11

| Invention Example Nr | silver behenate Crystallinity [$m^2/g$] | [g/$m^2$] | PVB [g/$m^2$] | R01 [g/$m^2$] | Phosphonium compound type | [g/$m^2$] | TA01 [g/$m^2$] | TA02 [g/$m^2$] | Oil [g/$m^2$] | S01 [g/$m^2$] | S02 [g/$m^2$] | S03 [g/$m^2$] |
|---|---|---|---|---|---|---|---|---|---|---|---|---|
| 24 | 1.62 | 5.27 | 21.1 | 1.07 | — | — | 0.32 | 0.16 | 0.047 | 0.08 | 0.38 | 0.14 |
| 25 | 2.25 | 4.56 | 18.3 | 0.93 | PC01 | 0.40 | 0.28 | 0.14 | 0.041 | 0.07 | 0.33 | 0.12 |
| 26 | 2.57 | 4.60 | 18.4 | 0.94 | PC02 | 0.38 | 0.28 | 0.14 | 0.041 | 0.07 | 0.33 | 0.12 |

The crystallinity values for the silver behenate present in the thermographic recording materials of INVENTION EXAMPLES 24 to 26 determined as described for COMPARATIVE EXAMPLES 4 to 6 and INVENTION EXAMPLES 8 to 15 are summarized in Table 12. It is clear from these results that the presence of the phosphonium compounds PC01 and PC02 has increased the crystallinity of the silver behenate in the recording materials of INVENTION EXAMPLES 25 & 26 over that of the silver behenate in the thermographic recording material of INVENTION EXAMPLE 24 with the same concentrations of the other ingredients.

Thermographic printing with the thermographic recording materials of INVENTION EXAMPLES 24 to 26 and the evaluation thereof were carried out as described for the thermographic recording materials of COMPARATIVE EXAMPLES 4 to 6 and INVENTION EXAMPLES 8 to 15. The evaluation results are summarized in Table 12.

TABLE 12

| Invention Example number | AgB crystallinity [$m^2/g$] | Phosphonium compound | print characteristics $D_{max}$ | $D_{min}$ | image tone from visual inspection | b* at minimum in b* vs OD |
|---|---|---|---|---|---|---|
| 24 | 1.62 | — | 3.87 | 0.08 | | −0.9 |
| 25 | 2.25 | PC01 | 2.84 | 0.07 | blue | −3.3 |
| 26 | 2.57 | PC02 | 3.10 | 0.06 | blue | −2.4 |

For the thermographic recording materials of INVENTION EXAMPLES 24 to 26 with the same composition, the increase in crystallinity upon addition of the phosphonium compounds at a concentration of 8 mol % with respect to the silver behenate present brought about, a desirable for image tone, reduction in the b*-value at the minimum in b* versus OD characteristic.

The thermographic recording materials of INVENTION EXAMPLES 27 to 31 were prepared using a silver behenate powder type XIII produced as described for INVENTION EXAMPLE 4 except that the addition time was 2.5 minutes instead of 1.5 minutes and the final % by weight of 2-butanone was 40.9 instead of 45. A silver behenate was prepared with the type XIV silver behenate powder by first preparing a predispersion by adding 56.5 g of the dried silver behenate powder type XII to a solution of 56.5 g of PVB in 389.2 g of 2-butanone and stirring for 10 minutes with an Ultra-Turrax™ stirrer. This predispersion was then microfluidized by passing it once through a MICROFLUIDICS™ M-110Y high pressure microfluidizer at a jet pressure of 400 bar to produce a 11.25% by weight dispersion of silver behenate in 2-butanone.

A subbed polyethylene terephthalate support having a thickness of 175 μm was doctor blade-coated from a coating composition containing 2-butanone as a solvent using the above-described silver behenate dispersions and the additional ingredients given below so as to obtain thereon, after drying for 1 hour at 50° C., layers with the compositions given in Table 13 for the thermographic recording materials of INVENTION EXAMPLES 27 to 31.

The crystallinity values for the silver behenate present in the thermographic recording materials of INVENTION EXAMPLES 27 to 31 determined as described for COMPARATIVE EXAMPLES 4 to 6 and INVENTION EXAMPLES 8 to 15 are also summarized in Table 13.

TABLE 13

| | silver behenate | | | | PC01 | | | | | | | |
|---|---|---|---|---|---|---|---|---|---|---|---|---|
| Invention Example Nr | Crystal-linity [$m^2$/g] | [g/$m^2$] | PVB [g/$m^2$] | R01 [g/$m^2$] | mol % vs AgB | [g/$m^2$] | TA01 [g/$m^2$] | TA02 [g/$m^2$] | Oil [g/$m^2$] | S01 [g/$m^2$] | S02 [g/$m^2$] | S03 [g/$m^2$] |
| 27 | 1.52 | 3.90 | 15.6 | 0.79 | 0 | 0 | 0.24 | 0.12 | 0.035 | 0.062 | 0.28 | 0.10 |
| 28 | 1.78 | 4.07 | 16.3 | 0.83 | 2 | 0.09 | 0.25 | 0.13 | 0.037 | 0.065 | 0.29 | 0.11 |
| 29 | 1.86 | 3.90 | 15.6 | 0.79 | 4 | 0.17 | 0.24 | 0.12 | 0.035 | 0.062 | 0.28 | 0.10 |
| 30 | 1.82 | 3.94 | 15.8 | 0.80 | 6 | 0.26 | 0.24 | 0.12 | 0.035 | 0.063 | 0.28 | 0.10 |
| 31 | 1.64 | 4.27 | 17.1 | 0.87 | 8 | 0.38 | 0.26 | 0.13 | 0.038 | 0.068 | 0.31 | 0.11 |

It is evident from table 13 that the crystallinities of the silver behenate in the thermographic recording materials of INVENTION EXAMPLES 28 to 31 in which the phosphonium compound PC01 is present are higher than that of the silver behenate in the thermographic recording material of INVENTION EXAMPLE 27 and moreover that there is an increase in silver behenate crystallinity with increasing PC01-concentration up to a concentration of 4 to 6 mol % with respect to the silver behenate present.

Thermographic printing with the thermographic recording materials of INVENTION EXAMPLES 27 to 31 and the evaluation thereof were carried out as described for the thermographic recording materials of COMPARATIVE EXAMPLES 4 to 6 and INVENTION EXAMPLES 8 to 15. The evaluation results are summarized in Table 14.

TABLE 14

| Invention | AgB | | print characteristics | | | |
|---|---|---|---|---|---|---|
| Example number | crystallinity [$m^2$g] | mol % PC01 vs AgB | $D_{max}$ | $D_{min}$ | image tone from visual inspection | b* at minimum in b* vs OD |
| 27 | 1.52 | 0 | 2.50 | 0.06 | blue | −5.1 |
| 28 | 1.78 | 2 | 2.54 | 0.06 | blue | −4.25 |
| 29 | 1.86 | 4 | 2.66 | 0.07 | blue | −4.55 |
| 30 | 1.83 | 6 | 2.65 | 0.07 | blue | −4.7 |
| 31 | 1.64 | 8 | 2.94 | 0.07 | blue | −3.8 |

The results of table 14 for thermographic recording materials of INVENTION EXAMPLES 28 to 31 with the phosphonium compound PC01 in different concentrations show comparable b*-values at the minimum in b versus OD characteristics to the thermographic recording material of INVENTION EXAMPLE 27 without a phosphonium compound.

INVENTION EXAMPLES AND COMPARATIVE EXAMPLES COMPRISING SILVER PALMITATE

Preparation of Prior Art Silver Palmitate According to RD17029

In the preparation of Types I & II silver palmitate, solution A was first prepared by adding 0.15 moles of solid sodium hydroxide to a dispersion of 0.1575 moles and 0.176 moles of palmitic acid respectively in 1L of deionized water at 68° C. thereby producing a solution of sodium palmitate with a pH of ca. 9. Solution B, 250 mL of 0.6M aqueous silver nitrate acidified 4 g of 65% nitric acid at a temperature of 58° C., was then added with vigorous stirring to solution A in 15 s while maintaining a temperature of 68° C. After 1 minute the resulting suspension of silver palmitate was cooled to room temperature and had a pH of ca. 5 and a UAg of ca. 350 mV. The silver palmitate was filtered off under reduced pressure, washed twice each time with about 5L of deionized water and dried in a forced air drying cupboard at 40° C.

Preparation of Silver Palmitate Dispersion

The quantities of type I and type II silver palmitates given in table 15 were dispersed with the quantities of deionized water, and 10% solution of Surfactant Nr 1 given in table 15 first with an ULTRATURRAX™ mixer to obtain a predispersion and then through a MICROFLUIDICS™ M-110Y high pressure microfluidizer at a jet pressure of 350 bar to produce the final dispersions with a concentration of 10.4%.

TABLE 15

| Comparative Example nr | silver palmitate type | silver palmitate quantity [g] | quantity of deionized water [g] | quantity of 10% solution of Surfactant Nr 1 [g] |
|---|---|---|---|---|
| 8 | I | 54 | 346 | 100 |
| 9 | II | 58 | 342 | 100 |

Preparation of a Tone Modifier Dispersion

The tone modifier dispersion was prepared by first dissolving 11 g of K7598 in 69 g of deionized water by first adding the gelatin, then allowing the gelatin to swell for 30 minutes and finally heating to 50° C. 20 g of TA02 was added with ULTRA-TURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of TA02 and 8.8% of gelatin.

Thermosensitive Element

The thermosensitive emulsion was produced as follows: 2.341 g of K7598 was allowed to swell for 30 minutes with deionized water (for quantity used in the preparation of the thermographic emulsion for the particular recording material see Table 16) and the resulting gel heated to 36° C., then with stirring the following ingredients were added: 5.699 g of the tone modifier dispersion at 36° C., then 8.120 g of LATEX 03 followed by 5 minutes stirring, the corresponding silver palmitate dispersion (for quantity and silver palmitate concentration therein for the thermosensitive emulsion for the particular recording material see Table 16) followed by 5 minutes stirring, 12.35 g of a 10.95% ethanol solution of R01 at 45° C. and finally 2.880 g of a 3.7% aqueous solution of formaldehyde.

The thermosensitive dispersions were doctor blade-coated onto a 175 μm subbed PET support and dried for 10 minutes at 50° C. thereby producing the thermosensitive elements of COMPARATIVE EXAMPLES 8 & 9.

TABLE 16

| Comparative Example number | quantity of water [g] | silver palmitate dispersion AgPa type | concentration (%) | quantity [g] |
|---|---|---|---|---|
| 8 | 20.120 | I | 10.397 | 38.490 |
| 9 | 20.150 | II | 10.406 | 38.460 |

Determination of Silver Palmitate Crystallinity in the Recording Materials

The crystallinity of the silver palmitate in the recording materials of COMPARATIVE EXAMPLES 8 & 9 was determined as follows:

i) 30 mm diameter samples of the recording materials of COMPARATIVE EXAMPLES 8 & 9 and of NIST standard 1976 were cut from larger sheets using a punch;

ii) X-ray diffraction scans were then carried out using a SIEMENS D5000 X-ray diffractometer equipped with a copper $K\alpha_1$ X-ray source operating at 40 keV and a current of 30 mA with the samples in the sample holder thereof to scan the samples of COMPARATIVE EXAMPLES 8 & 9 and NIST standard 1976, with the same X-ray diffractometer in exactly the same state of adjustment, in steps of 0.05 degrees at a rate of 1 step/s between Bragg angles, 2Θ, of 2° and 50° and the data processed using SIEMENS DIFFRAC™ AT software to produce X-ray diffraction spectra corrected for background and exact peak heights (maxima) of each X-ray diffraction peak;

iii) the $K_{material}$ values were then determined for the recording materials of COMPARATIVE EXAMPLES 8 & 9 by adding up the peak heights (maxima) of the X-ray diffraction lines attributable to silver palmitate at Bragg angles, 2Θ, of 4.01°, 6,049°, 8,031°, 10.06°, 12.08° and 14.09°;

iv) the $K_{1976}$ value was determined for NIST standard 1976 by adding up the peak heights (maxima) of the X-ray diffraction lines at Bragg angles, 2Θ, of 25.60°, 35.16° and 43.40°;

v) the weights of silver in g/m², $C_{Ag}$, of the recording materials of COMPARATIVE EXAMPLES 8 & 9 were determined using a PHILIPS PW2400 wavelength dispersive X-ray fluorescence apparatus with a chromium $K_\alpha$ X-ray source operating at 60 keV and a current of 50 mA, which had been calibrated for silver using silver-containing samples for which the silver concentrations had been determined using standard volumetric titration techniques; and vi) the crystallinity values for the silver palmitate present in the recording materials of COMPARATIVE EXAMPLES 8 & 9 were determined using the expression:

$$K_{material}/(K_{1976}\times\sqrt{C_{Ag}}).$$

The crystallinity values for the silver palmitate in the recording materials of COMPARATIVE EXAMPLES 8 & 9 are given in Table 17.

Thermographic Printing

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors, was 1.6 mJ/dot and was sufficient to obtain maximum optical density in each of the thermographic materials of COMPARATIVE EXAMPLES 8 & 9.

During printing of the recording materials of COMPARATIVE EXAMPLES 8 & 9 the printhead was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The maximum densities, $D_{max}$, and minimum densities, $D_{min}$, of the prints given in table 3 were measured through a visible filter with a MacBeth™ TR924 densitometer in the grey scale steps corresponding to data levels of 64 and 0 respectively and are given in Table 17 for COMPARATIVE EXAMPLES 8 & 9.

Shelf-Life Test

The shelf-life of the recording materials of COMPARATIVE EXAMPLES 8 & 9 was evaluated on the basis of the changes in minimum and maximum density measured through a visible filter using a MacBeth™ TR924 densitometer upon thermographic printing after heating the recording materials at 57° C. in a relative humidity of 34% for 3 days in the dark. The results are given in Table 17.

TABLE 17

| Comparative | Silver palmitate | | | Fresh print characteristics | | shelf-life |
|---|---|---|---|---|---|---|
| Example Number | type | coating weight[g/m$^2$] | crystal-linity [m/g$^{1/2}$] | $D_{max}$ (vis) | $D_{min}$ (vis) | $\Delta D_{max}/\Delta D_{min}$ (vis) after 3d at 57° C./34% RV |
| 1 | I | 3.40 | 2.45 | 3.41 | 0.07 | +0.48/+0.01 |
| 2 | II | 3.60 | 1.62 | 3.57 | 0.07 | +0.33/+0.01 |

Preparation of Prior Art Silver Palmitate According to EP-A 754 969

In COMPARATIVE EXAMPLE 10, a sodium palmitate solution was first prepared by dissolving with stirring 24.5 g of sodium palmitate in a mixture of 80 mL of 2-propanol and 288 mL of deionized water at 70° C. to give a 6.53% by weight solution.

The synthesis of silver palmitate type VI according to EP-A 754 969 was then carried out at a constant UAg of 400 mV as follows: to a stirred solution of 30 g of K17881 in 1000 mL of distilled water at 71° C. in a double walled reactor, several drops of a 2.94M aqueous solution of silver nitrate were added to adjust the UAg at the start of the reaction to 400 mV and then 340 g of the above-mentioned sodium palmitate solution at a temperature of 75° C. was metered into the reactor at a rate of 48 mL/min and simultaneously a 3.792% by weight aqueous solution of silver nitrate was metered into the reactor, its addition rate being controlled by the quantity of the silver nitrate solution necessary to maintain a UAg of 400±5 mV in the dispersing medium in the reactor. Both the sodium palmitate and silver nitrate solutions were added to the dispersing medium via small diameter tubes positioned just under the surface of the dispersing medium. By the end of the addition step 0.080 moles of sodium behenate and 0.094 moles of silver nitrate had been added. The mixture was then stirred for a further 30 minutes. The resulting silver palmitate dispersion contained 1.63% by weight of silver behenate and 1.69% by weight of K17881.

0.25 g of K17881 was added per 100 g of silver palmitate dispersion together with 6% of Surfactant Nr. 4 and the resulting dispersion doctor blade coated to a silver palmitate coverage of 3.23 g/m$^2$ after drying. The crystallinity of the silver palmitate in the resulting material was determined as described for COMPARATIVE EXAMPLES 8 & 9 to be 2.99 ml/g$^2$, see Table 18.

TABLE 18

| Comparative Example | Silver palmitate | | |
|---|---|---|---|
| number | type | coating weight [g/m$^2$] | Crystallinity [m/g$^{1/2}$] |
| 10 | VI | 3.23 | 2.99 |

Therefore the silver salt production process of EP-A 754 969 produces silver palmitate with a crystallinity, as determined according to the present invention, below 3.09 M/g$^{0.5}$ and hence outside the disclosure of the present invention.

Preparation of Silver Palmitate According to the Present Invention

The synthesis of type III silver palmitate was carried out in the dark in a thermostatted stainless steel vessel with pH, pAg and temperature being continually monitored. The reagents were brought to the same temperature as the vessel prior to addition and were added at a known rate by a pumping system controlled by a computer with appropriate software.

For the syntheses of silver palmitate the following programme settings were used:

heating to 65° C.;

addition of a known quantity of a 0.255 mol/L solution of NaOH;

addition of a known quantity of a 0.401 mol/L solution of $AgNO_3$;

all steps with pre and post washing.

Palmitic acid was dissolved in ethanol at 65° C. 0.255N aqueous sodium hydroxide was added until the equivalence point was attained thereby obtaining the sodium salt. A 0.401M aqueous solution of silver nitrate was then added to convert the sodium salt to silver palmitate. The silver palmitate was then filtered off under reduced pressure, washed twice with deionized water and dried.

75 g of dried type III silver palmitate was dispersed in 75 g of a 10% aqueous solution of Surfactant Nr 1 by first producing a coarse suspension using an ULTRATURRAX™ and then dispersing the resulting coarse suspension in a MICROFLUIDICS™ M-110Y high pressure microfluidizer at a jet pressure of at 350 bar to produce the final dispersion with 20.173% silver palmitate.

Thermosensitive Element

The thermosensitive element of the recording material of INVENTION EXAMPLE 32 was produced as described for the thermosensitive element of the recording material of COMPARATIVE EXAMPLES 8 & 9 except that the quantity of deionized water, the silver palmitate type, concentration and quantity of dispersion used were as given in Table 19 below.

TABLE 19

| Invention Example | quantity of | silver palmitate dispersion | | |
|---|---|---|---|---|
| number | water [g] | AgPa type | Concentration (%) | quantity [g] |
| 32 | 18.18 | III | 20.17 | 19.810 |

The crystallinity value for the silver palmitate present in the recording materials of INVENTION EXAMPLE 32 determined as described for COMPARATIVE EXAMPLES 8 & 9 is given in Table 20.

Thermographic Evaluation

Thermographic printing with the recording material of INVENTION EXAMPLE 32 and the evaluation thereof were carried out as described for the recording materials of COMPARATIVE EXAMPLES 8 & 9. The evaluation results are summarised in Table 20.

TABLE 20

| Invention | Silver palmitate | | | Fresh print characteristics | | shelf-life |
|---|---|---|---|---|---|---|
| Example Number | type | Coating Weight[g/m$^2$] | crystal-linity [m/g½] | $D_{max}$ (vis) | $D_{min}$ (vis) | $\Delta D_{max}/\Delta D_{min}$ (vis) after 3d at 57° C./34% RV |
| 32 | III | 3.40 | 3.10 | 3.51 | 0.07 | +0.23/+0.01 |

These results show a considerable improvement in the shelf-life of the recording material of INVENTION EXAMPLE 32 compared with the recording materials of COMPARATIVE EXAMPLES 8 & 9 using prior art silver palmitate as demonstrated by a reduced increase in $D_{max}$ while maintaining $D_{min}$-stability. The recording material of INVENTION EXAMPLE 32 only differs from those of COMPARATIVE EXAMPLES 8 & 9 in that they contain silver palmitate with an increased crystallinity. This demonstrates the beneficial effect of increased silver palmitate crystallinity on the stability of recording materials.

Preparation of Silver Palmitate Dispersions in an Aqueous Medium in the Absence of Organic Solvent Using a Single Jet Process Aqueous dispersions of the silver palmitate types IV & V were produced as follows:

i) dispersing palmitic acid (for quantity see Table 21) with stirring at a given temperature (see Table 21) in a mixture of deionized water (for quantity see Table 21) and a 10% solution of Surfactant Nr 1 (for quantity see Table 21) to produce a dispersion with a pH of about 4.2;

ii) then adding a quantity of sodium hydroxide as a 2M aqueous solution (for quantity see Table 21) at the same temperature as the palmitic acid dispersion with stirring over a particular time (see Table 21 for the time of addition) thereby producing a clear solution with a pH of about 9.2 substantially containing sodium palmitate;

iii) then metered addition of a particular quantity of silver nitrate (same quantity in moles as for sodium hydroxide) as a 1M aqueous solution at the same temperature as the palmitic acid dispersion with stirring at a particular rate [for rate given as moles/(moles silver palmitate×min) see Table 21] to convert the sodium palmitate completely into silver palmitate as a dispersion with a pH and UAg as given in Table 21; and iv) ultrafiltration with a 500000 MW polysulfone cartridge filter at room temperature to concentrate the resulting silver palmitate dispersion (final AgPa-concentration and residual conductivity in mS/cm are given in Table 22).

The volume average particle size as determined by a Coulter LS230 diffractometer is also given in Table 22.

TABLE 21

| Invention example nr | AgPa type | quantity of palmitic acid [moles] | quantity of deionized water [L] | quantity of 10% sol. of Surfactant Nr 1 [L] | temperature [° C.] | quantity of NaOH & $AgNO_3$ [moles] | addition time of 2M NaOH [min] | mol $AgNO_3$ /(mol AgPa x min) | pH | UAg [mV] |
|---|---|---|---|---|---|---|---|---|---|---|
| 33 | IV | 1.507 | 2.495 | 2.027 | 63 | 1.477 | 9.75 | 0.0650 | 6.40 | +320 |
| 34 | V | 0.4 | 0.662 | 0.538 | 63 | 0.392 | 10 | 0.25 | 5.76 | +405 |

TABLE 22

| Invention Number nr | AgPa type | Ultrafiltration residual conductivity [mS/cm] | % AgPa dispersion | average particle size [nm] |
|---|---|---|---|---|
| 33 | IV | 3.4 | 15.85 | 725 |
| 34 | V | 3.45 | 15.52 | |

These dispersions of silver palmitate were directly used in the preparation of the recording materials of INVENTION EXAMPLES 33 & 34.

Thermosensitive Element

The thermosensitive elements of the recording materials of INVENTION EXAMPLES 33 & 34 were produced as described for the thermosensitive element of the recording material of COMPARATIVE EXAMPLES 8 & 9 except that the quantity of deionized water used, the silver palmitate type, concentration and quantity of dispersion used were as given in Table 23 below.

TABLE 23

| Invention Example number | quantity of water [g] | silver palmitate dispersion AgPa type | concentration (%) | quantity [g] |
|---|---|---|---|---|
| 33 | 13.397 | IV | 15.85 | 25.213 |
| 34 | 12.820 | V | 15.49 | 25.790 |

The crystallinity values for the silver palmitate present in the recording materials of INVENTION EXAMPLES 33 & 34 determined as described for COMPARATIVE EXAMPLES 8 & 9 are given in Table 24.

Thermographic Evaluation

Thermographic printing with the recording materials of INVENTION EXAMPLES 33 & 34 and the evaluation thereof were carried out as described for the recording material of COMPARATIVE EXAMPLES 8 & 9. The evaluation results are summarized in Table 24.

TABLE 24

| Invention | Silver palmitate | | | Fresh print characteristics | | shelf-life |
|---|---|---|---|---|---|---|
| Example Number | type | coating weight[g/m$^2$] | crystal-linity [m/g½] | $D_{max}$ (vis) | $D_{min}$ (vis) | $\Delta D_{max}/\Delta D_{min}$ (vis) after 3d at 57° C./34% RV |
| 33 | IV | 3.17 | 5.81 | 3.16 | 0.07 | −0.17/+0.01 |
| 34 | V | 2.90 | 3.99 | 3.04 | 0.08 | +0.08/0.00 |

These results show a considerable improvement in the shelf-life of recording materials of INVENTION EXAMPLES 33 & 34 compared with the recording materials of COMPARATIVE EXAMPLES 8 & 9 using prior art silver palmitate as demonstrated by a reduced increase in $D_{max}$ while maintaining $D_{min}$-stability. The recording materials of INVENTION EXAMPLES 33 & 34 only differ from those of COMPARATIVE EXAMPLES 8 & 9 in that they contain silver palmitate with an increased crystallinity. This demonstrates the beneficial effect of increased silver palmitate crystallinity on the stability of recording materials.

INVENTION EXAMPLES AND COMPARATIVE EXAMPLES RELATED TO SILVER STEARATE

Preparation of Prior Art Silver Stearate According to RD 17029

In the preparation of Types I & II silver stearate, solution A was first prepared by adding 0.15 moles of solid sodium hydroxide to a dispersion of 0.1575 moles and 0.176 moles of stearic acid in 1L of deionized water at 75° C. thereby producing a solution of sodium stearate with a pH of ca. 9. Solution B, 250 mL of 0.6M aqueous silver nitrate acidified with 0.4 g of 65% nitric acid at a temperature of 65° C., was then added with vigorous stirring to solution A in 15 s while maintaining a temperature of 75° C. After 1 minute the resulting suspension of silver stearate was cooled to room temperature and had a pH of ca. 5 and a UAg of ca. 310 mV. The silver stearate was filtered off under reduced pressure, washed twice each time with about 5L of deionized water and dried in a forced air drying cupboard at 40° C.

Preparation of Silver Stearate Dispersions

The quantities of type I and type II silver stearates given in Table 25 were dispersed with the quantities of deionized water and 10% solution of Surfactant Nr 1 given in Table 25 first with an ULTRATURRAX™ mixer to obtain a predispersion and then through a MICROFLUTIDICS™ M-110Y high pressure microfluidizer at a jet pressure of 350 bar to produce the final dispersions with concentrations of 11.5% and 11.3% respectively.

TABLE 25

| Comparative | silver stearate | | quantity of | Quantity of 10% solution of Surfactant |
|---|---|---|---|---|
| Example nr | type | quantity [g] | deionized water [g] | Nr 1 [g] |
| 11 | I | 58 | 342 | 100 |
| 12 | II | 60 | 340 | 100 |

Preparation of a Tone Modifier Dispersion

The tone modifier dispersion was prepared by first dissolving 11 g of K7598 in 69 g of deionized water by first adding the gelatin, then allowing the gelatin to swell for 30 minutes and finally heating to 50° C. 20 g of TA02 was added with ULTRATURRAX™ stirring to this gelatin solution at 50° C., and the stirring continued for a further 5 minutes. Finally the resulting dispersion was pumped through a DYNOMILL™ for 2 hours to produce the final tone modifier dispersion containing: 20% of TA02 and 11% of gelatin.

Thermosensitive Element

The thermosensitive emulsion was produced as follows: 2.341 g of K7598 was allowed to swell for 30 minutes with deionized water (for the quantity used in the preparation of the thermographic emulsion for the particular recording material see Table 26) and the resulting gel heated to 36° C. The following ingredients were then added with stirring: 5.699 g of the tone modifier dispersion at 36° C., then 8.120 g of LATEX 03 followed by 5 minutes stirring, the corresponding silver stearate dispersion (for quantity and silver stearate concentration therein used for the thermosensitive emulsion for the particular recording material see Table 26) followed by 5 minutes stirring, 12.35 g of a 10.95% ethanol solution of R01 at 45° C. and finally 2.880 g of a 3.7% aqueous solution of formaldehyde.

The thermosensitive dispersions were then doctor blade-coated onto a 175 μm subbed PET support and dried for 10 minutes at 50° C. thereby producing the thermosensitive elements of COMPARATIVE EXAMPLES 11 & 12.

TABLE 26

| Comparative | quantity of | silver stearate dispersion | | |
|---|---|---|---|---|
| Example nr | water [g] | AgSt type | concentration (%) | quantity [g] |
| 11 | 20.140 | I | 11.504 | 37.470 |
| 12 | 20.450 | II | 11.298 | 38.160 |

Determination of Silver Stearate Crystallinity in the Recording Materials

The crystallinity of the silver stearate in the recording materials of COMPARATIVE EXAMPLES 11 & 12 was determined as follows:

i) 30 mm diameter samples of the recording materials of COMPARATIVE EXAMPLES 11 & 12 and of NIST standard 1976 were cut from larger sheets using a punch;

ii) X-ray diffraction scans were then carried out using a SIEMENS D5000 X-ray diffractometer equipped with a copper $K\alpha_1$ X-ray source operating at 40 keV and a current of 30 mA with the samples in the sample holder thereof to scan the samples of COMPARATIVE EXAMPLES 11 & 12 and NIST standard 1976, with the same X-ray diffractometer in exactly the same state of adjustment, in steps of 0.05 degrees at a rate of 1 step/s between Bragg angles, 2Θ, of 2° and 50° C. and the data processed using SIEMENS DIFFRAC™ AT software to produce X-ray diffraction spectra corrected for background and exact peak heights (maxima) of each X-ray diffraction peak;

iii) the $K_{material}$ values were then determined for the recording materials of COMPARATIVE EXAMPLES 11 & 12 by adding up the peak heights (maxima) of the X-ray diffraction lines attributable to silver stearate at Bragg angles, 2Θ, of 3.62°, 5.45°, 7.30°, 9.04°, 10.97° and 12.71°;

iv) the $K_{1976}$ value was determined for NIST standard 1976 by adding up the peak heights (maxima) of the X-ray diffraction lines at Bragg angles, 2Θ, of 25.60°, 35.16° and 43.40°;

v) the weights of silver in g/m$^2$, $C_{Ag}$, of the recording materials of COMPARATIVE EXAMPLES 11 & 12 were determined using a PHILIPS PW2400 wavelength dispersive X-ray fluorescence apparatus with a chromium $K_\alpha$ X-ray source operating at 60 keV and a current of 50 mA, which had been calibrated for silver using silver-containing samples for which the silver concentrations had been determined using standard volumetric titration techniques; and vi) the crystallinity values for the silver stearate present in the recording materials of COMPARATIVE EXAMPLES 11 & 12 were determined using the expression:

$$K_{material}/(K_{1976}\times\sqrt{C_{Ag}}).$$

The crystallinity values for the silver stearate in the recording materials of COMPARATIVE EXAMPLES 11 & 12 are given in Table 27.

Thermographic Printing

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors, was 1.6 mJ/dot and was sufficient to obtain maximum optical density in the thermographic recording materials of COMPARATIVE EXAMPLES 11 & 12.

During printing of the recording materials of COMPARATIVE EXAMPLES 11 & 12 the printhead was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The maximum densities, $D_{max}$, and minimum densities, $D_{min}$, of the prints given in Table 27 were measured through a visible filter with a MacBeth™ TR924 densitometer in the grey scale steps corresponding to data levels of 64 and 0 respectively and are given in Table 27 for COMPARATIVE EXAMPLES 11 & 12.

Shelf-Life Test

The shelf-life of the recording materials of COMPARATIVE EXAMPLES 11 & 12 was evaluated on the basis of the observed changes in minimum and maximum density measured through a visible filter using a MacBeth™ TR924 densitometer upon thermographic printing after heating the recording materials at 57° C. in a relative humidity of 34% for 3 days in the dark. The results are given in Table 27.

Archivability Test

The achivability of prints made with the recording materials of COMPARATIVE EXAMPLES 11 & 12 was evaluated on the basis of the changes in minimum and maximum density, $D_{min}$ and $D_{max}$, measured through a visible filter using a MacBeth™ TR924 densitometer upon heating the prints at 57° C. in a relative humidity (RH) of 34% for 3 days in the dark. The results are given in Table 27.

TABLE 27

| Comparative example number | Silver stearate type | coating weight [g/m$^2$] | crystallinity [m/g$^{1/2}$] | fresh print characteristics $D_{max}$ (vis) | $D_{min}$ (vis) | archivability $\Delta D_{max}/\Delta D_{min}$ (vis) after 3d at 57° C./34% RV | shelf-life $\Delta D_{max}/\Delta D_{min}$ (vis) after 3d at 57° C./34% RV |
|---|---|---|---|---|---|---|---|
| 11 | I | 3.99 | 2.01 | 3.20 | 0.08 | +0.43/0.00 | +0.51/0.00 |
| 12 | II | 3.66 | 1.44 | 3.21 | 0.07 | +0.46/+0.01 | +0.55/+0.02 |

Preparation of Prior Art Silver Stearate According to EP-A 754 969

In COMPARATIVE EXAMPLE 13, a sodium stearate solution was prepared by dissolving with stirring 27.0 g of sodium stearate in a mixture of 80 mL of 2-propanol and 285.5 mL of deionized water at 75° C. to give a 7.19% by weight solution.

The synthesis of silver stearate type VI according to EP-A 754 969 was then carried out at a constant UAg of 400 mV as follows: to a stirred solution of 30 g of K17881 in 1000 mL of distilled water at 71° C. in a double walled reactor, several drops of a 2.94M aqueous solution of silver nitrate were added to adjust the UAg at the start of the reaction to 400 mV and then 340 g of the above-mentioned sodium stearate solution at a temperature of 75° C. was metered into the reactor at a rate of 48 mL/min and simultaneously a 3.792% by weight aqueous solution of silver nitrate was metered into the reactor, its addition rate being controlled by the quantity of the silver nitrate solution necessary to maintain a UAg of 400±5 mV in the dispersing medium in the reactor. Both the sodium stearate and silver nitrate solutions were added to the dispersing medium via small diameter tubes positioned just under the surface of the dispersing medium. By the end of the addition step 0.080 moles of sodium behenate and 0.087 moles of silver nitrate had been added. The mixture was then stirred for a further 30 minutes. The resulting silver stearate dispersion contained 1.79% by weight of silver behenate and 1.72% by weight of K17881.

5 g of K16353 was added per 100 g of silver stearate dispersion together with 6% of Surfactant Nr. 4 and the resulting dispersion doctor blade coated to a silver stearate coverage of 0.98 g/m$^2$ after drying. The crystallinity of the silver stearate in the resulting material was determined as described for COMPARATIVE EXAMPLES 11 & 12 to be 1.80, see Table 28.

TABLE 28

| Comparative | Silver stearate | | |
|---|---|---|---|
| Example number | type | coating weight [g/m$^2$] | crystallinity [m/g$^{e,fra}$ 1/2] |
| 13 | VI | 0.98 | 1.80 |

Therefore the silver salt production process of EP-A 754 969 produces silver stearate with a crystallinity, as determined according to the present invention, below 2.2 m/g$^{0.5}$ and hence outside the disclosure of the present invention.

Preparation of Silver Stearate Dispersions in an Aqueous Medium in the Absence of Organic Solvent Using a Single Jet Process Aqueous dispersions of the silver stearate types III to V were produced as follows:

i) dispersing stearic acid (for quantity see Table 29) with stirring at a given temperature (see Table 29) in a mixture of deionized water (for quantity see Table 29) and a 10% solution of Surfactant Nr 1 (for quantity see Table 29) to produce a dispersion with a pH of about 4.2;

ii) then adding a quantity of 2M aqueous sodium hydroxide (for quantity see Table 29) at the same temperature as the stearic acid dispersion with stirring over a particular time (see Table 29 for the time of addition) thereby producing a clear solution with a pH of about 9.2 substantially containing sodium stearate;

iii) then metered addition of a particular quantity of an aqueous 1M silver nitrate solution (same quantity in moles as for sodium hydroxide) at the same temperature as the stearic acid dispersion with stirring at a particular rate (for rate given as moles/[moles silver stearate×min) see Table 29] to convert the sodium stearate completely into silver stearate as a dispersion with a pH and UAg as given in Table 29; and iv) ultrafiltration with a 500000 MW polysulfone cartridge filter at room temperature to concentrate the resulting silver stearate dispersion (final AgSt-concentration and residual conductivity in mS/cm are given in Table 30).

The volume average particle size as determined by a Coulter LS230 diffractometer is also given in Table 30.

TABLE 29

| Invention example number | AgSt type | quantity of stearic acid [moles] | quantity of deionized water [L] | quantity 10% sol. of Surfactant Nr 1 [L] | temperature [° C.] | quantity of NaOH & $AgNO_3$ [moles] | addition time of 2M NaOH [min] | mol $AgNO_3$ (mol AgSt x min) | pH | UAg [mV] |
|---|---|---|---|---|---|---|---|---|---|---|
| 35 | III | 1.507 | 2.495 | 2.027 | 80 | 1.477 | 9.75 | 0.0650 | 6.61 | +314 |
| 36 | IV | 0.4 | 0.662 | 0.538 | 70 | 0.392 | 10 | 0.25 | 5.84 | +464 |
| 37 | V | 0.4 | 0.893 | 0.307 | 70 | 0.392 | 10 | 0.25 | 7.05 | +310 |

TABLE 30

| | | Ultrafiltration | | |
|---|---|---|---|---|
| Invention Example nr | AgSt type | residual conductivity [mS/cm] | % AgSt dispersion | average particle size [nm] |
| 35 | III | 3.2 | 16.86 | 339 |
| 36 | IV | 3.4 | 18.56 | |
| 37 | V | 2.0 | 19.31 | 3381 |

These dispersions of silver stearate were directly used in the preparation of the recording materials of INVENTION EXAMPLES 35 to 37.

Thermosensitive Element

The thermosensitive elements of the recording materials of INVENTION EXAMPLES 35 to 37 were produced as described for the thermosensitive elements of the recording materials of COMPARATIVE EXAMPLES 11 & 12 except that the quantity of deionized water, the silver stearate type, concentration and quantity of dispersion used were as given in Table 31 below.

TABLE 31

| Invention | quantity of | silver stearate dispersion | | |
|---|---|---|---|---|
| Example nr | water [g] | AgSt type | concentration (%) | quantity [g] |
| 35 | 13.078 | III | 16.86 | 25.532 |
| 36 | 15.380 | IV | 18.56 | 23.230 |
| 37 | 16.290 | V | 19.31 | 22.320 |

The crystallinity values for the silver stearate in the recording materials of INVENTION EXAMPLES 35 to 37 determined as described for COMPARATIVE EXAMPLE 11 & 12 are given in Table 32.

Thermographic Evaluation

Thermographic printing with the recording materials of INVENTION EXAMPLES 35 to 37 and the evaluation thereof were carried out as described for the recording material of COMPARATIVE EXAMPLES 11 and 12. The results are summarized in Table 32.

TABLE 32

| Invention example number | Silver stearate type | coating weight [g/m²] | crystallinity [m/g^1/2] | fresh print characteristics $D_{max}$ (vis) | $D_{min}$ (vis) | archivability $\Delta D_{max}/D_{min}$ (vis) after 3d at 57° C./34% RV | shelf-life $\Delta D_{max}/D_{min}$ (vis) after 3d at 57° C./34% RV |
|---|---|---|---|---|---|---|---|
| 35 | III | 3.37 | 2.48 | 3.24 | 0.07 | +0.25/0.00 | +0.19/0.00 |
| 36 | IV | 3.12 | 3.51 | 3.12 | 0.07 | +0.17/+0.01 | −0.19/0.00 |
| 37 | V | 3.81 | 3.16 | 3.38 | 0.07 | +0.24/+0.01 | −0.14/+0.01 |

These results show a considerable improvement in the shelf-life of recording materials of INVENTION EXAMPLES 35 to 37 and in the archivability of prints made therewith compared with prior art recording materials of COMPARATIVE EXAMPLES 11 and 12 as demonstrated by a reduced increase in $D_{max}$, while maintaining $D_{min}$-stability. The recording materials of INVENTION EXAMPLES 35 to 37 only differ from those of COMPARATIVE EXAMPLES 11 & 12 in that they contain silver stearate with an increased crystallinity. This demonstrates the beneficial effect of increased silver stearate crystallinity on the stability of recording materials.

The photothermographic recording materials of COMPARATIVE EXAMPLE 14 and INVENTION EXAMPLE 38 were prepared using the aqueous dispersions of type II and type IV silver stearate respectively prepared as described for COMPARATIVE EXAMPLE 12 and INVENTION EXAMPLE 36 respectively.

Photo-Addressable Thermally Developable Elements

The photo-addressable thermally developable element was produced as follows: 2.1 g of K7598 was allowed to swell for 30 minutes in 8.4 g of deionized water and the resulting gel heated to 36° C., then with stirring the following ingredients were added: 2.5 g of an aqueous gelatinous emulsion of $AgBr_{0.97}I_{0.03}$ (6% by weight in gelatin and 13.36% by weight in $AgBr_{0.97}I_{0.03}$), silver stearate dispersion (for the quantity and concentration, see table 33), adjustment of the dispersion pH to 5.20 by addition of 1.25 g of nitric acid, 2.240 g of a 5.26% methanol solution of trimethylphenylammonium bromide perbromide, 9.804 g of a 21.4% aqueous dispersion of LATEX 03, 1.606 g of an aqueous solution containing 18.68% of tribromomethylphenyl-sulfone, 9.3% of K7598 and 0.93% of Surfactant Nr 1 and finally 12.22 g of a dispersion of 17.82% of R03, 1.98% of Surfactant Nr 5 and 4.95% of phthalazine. The resulting dispersions were then doctor blade-coated onto a 175 μm subbed PET support and dried for 10 minutes at 50° C. to produce the photo-addressable thermally developable elements of the photothermographic recording materials of COMPARATIVE EXAMPLE 14 & INVENTION EXAMPLE 38 with a silver stearate coating weight of about 5.7 g/m². These photo-addressable thermally developable elements were then overcoated using a 50 μm doctor blade with 45 g of an aqueous solution consisting of 6.67% of K7598, 0.44% of 4-methylphthalic acid and 4.44% of the ammonium salt of perfluoro-octanoic acid to produce, after drying at 50° C. for 10 minutes, the photothermographic recording materials of COMPARATIVE EXAMPLE 14 and INVENTION EXAMPLE 38.

TABLE 33

| | silver stearate dispersion AgSt type | concentration [%] | quantity [g] |
|---|---|---|---|
| COMPARATIVE EXAMPLE 14 | II | 11.298 | 50.612 |
| INVENTION EXAMPLE 38 | IV | 18.531 | 30.808 |

The crystallinity values for the silver stearate present in the photothermographic recording materials of COMPARATIVE EXAMPLE 14 and INVENTION EXAMPLE 38 determined as described for COMPARATIVE EXAMPLES 11 & 12 are given in Table 34.

Photothermographic Evaluation

The photothermographic recording materials of COMPARATIVE EXAMPLE 14 & INVENTION EXAMPLE 38 were then exposed to ultra-violet light through a test original in contact with the material in an AGFA-GEVAERT™ DL 1000 exposure apparatus followed by heating on a heated metal block for the times and at the temperatures given in Table 34 to produce a good image. The maximum densities, $D_{max}$, and minimum densities, $D_{min}$, of fresh prints measured through a UV-filter and through a visible filter with a MacBeth™ TD905 densitometer in the grey scale steps corresponding to data levels of 64 and 0 respectively are given for the photothermographic recording materials COMPARATIVE EXAMPLE 14 and INVENTION EXAMPLE 38 in Tables 34 and 35 respectively.

Shelf-Life Test

The shelf-life of the recording materials of COMPARATIVE EXAMPLE 14 and INVENTION EXAMPLE 38 was evaluated on the basis of the changes in minimum and maximum density measured through a UV-filter and through a visible filter using a MacBeth™ TD905 densitometer upon thermographic printing after heating the recording materials at 35° C. in a relative humidity of 80% for 3 days in the dark. The results are given in Tables 34 and 35 respectively.

Light Box Test

The stability of unprocessed sheets of the photothermographic recording materials of COMPARATIVE EXAMPLE 14 and INVENTION EXAMPLE 38 to room lighting was evaluated on the basis of the change in density measured through a UV filter using a MacBeth™ TD905 densitometer upon exposure on top of the white PVC window of a specially constructed light-box placed for 3 days in a Votsch conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 Planilux™ TLD 36W/54 fluorescent lamps 27 mm in diameter mounted length-wise equidistant from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in Tables 34 and 35.

TABLE 34

| Comparative example | Silver stearate | | | fresh print characteristics upon printing for 10s at 105° C. | | light box | shelf-life in dark |
|---|---|---|---|---|---|---|---|
| | | coating weight | crystallinity | | | $\Delta D_{min}$ (UV) after 3d at 30° C./85% RH | $\Delta D_{max}/\Delta D_{min}$ (UV) after 3d at 35° C./80% RH |
| Number | type | [g/m$^2$] | [m/g$^{1/2}$] | $D_{max}$ (UV) | $D_{min}$ (UV) | unprocessed sheets | printing at 105° C./10s |
| 14 | II | 5.55 | 1.76 | 4.95 | 0.25 | 0.55 | −0.70/−0.02 printing at 110° C./10s |
| Invention example nr 38 | IV | 4.93 | 3.61 | 3.41 | 0.19 | 0.17 | −0.18/−0.17 |

TABLE 35

| Comparative example | Silver stearate | | | fresh print characteristics upon printing for 10s at 105° C. | | shelf-life in dark |
|---|---|---|---|---|---|---|
| | | coating weight | crystallinity | | | $\Delta D_{max}/\Delta D_{min}$ (vis) after 3d at 35° C./80% RH |
| Number | type | [g/m$^2$] | [m/g$^{e,fra}$ 1/2] | $D_{max}$ (VIS) | $D_{min}$ (VIS) | for printing at 105° C./10s |
| 14 | II | 5.55 | 1.76 | 1.45 | 0.08 | −0.23/−0.02 for printing at 110° C./10s |
| Invention example nr 38 | IV | 4.93 | 3.61 | 2.13 | 0.12 | +0.06/−0.10 |

The results in Tables 34 and 35 show a considerable improvement in the shelf-life stability of the photothermographic recording material of INVENTION EXAMPLES 38 compared with the photothermographic recording material of COMPARATIVE EXAMPLE 14 using prior art silver stearate as demonstrated by a reduced increase in $D_{max}$ while maintaining $D_{min}$-stability as measured both through a UV-filter and through a visible filter. The results in Table 34 also show an increased stability of the photothermographic recording material of INVENTION EXAMPLE 38 to room lighting compared with the photothermographic recording material of COMPARATIVE EXAMPLE 14 using prior art silver stearate, as shown by a reduced increase in density measured through a UV-filter. The optical density measured through a UV-filter is relevant to the use of photothermographic materials for copying purposes in which UV-light is used. The photothermographic recording material of INVENTION EXAMPLE 38 only differs from that of COMPARATIVE EXAMPLE 14 in that it contains silver stearate with an increased crystallinity. This demonstrates the beneficial effect of increased silver stearate crystallinity on the stability of photothermographic recording materials.

Having described in detail preferred embodiments of the current invention, it will now be apparent to those skilled in the art that numerous modifications can be made therein without departing from the scope of the invention as defined in the following claims.

We claim:

1. A process for producing a dispersion of particles of substantially light-insensitive organic silver salts primarily comprising a silver salt of an organic carboxylic acid in a substantially solvent-free aqueous medium, said process comprising:

(i) preparing an aqueous dispersion comprising one or more organic acids primarily containing organic carboxylic acid anionic surfactant;

(ii) substantially neutralizing said organic acids with aqueous alkali, thereby forming organic acid salts; and (iii) adding an aqueous solution of a silver salt to completely convert said organic acid salts into their corresponding silver salts;

wherein said anionic surfactant is present in a molar ratio of greater than 0.15 with respect to the organic acids, and said silver salt is added at a rate of between 0.025 mol/(mol organic silver salt×mm) and 2.25 mol/(mol organic silver salt×mm).

2. The process according to claim 1, wherein the organic acid is an aliphatic carboxylic acid.

3. The process according to claim 1, wherein the organic acid is an aliphatic carboxylic acid, wherein the aliphatic carbon chain has at least 12 carbon atoms.

4. The process according to claim 1, wherein the organic acid primarily comprises behenic acid, palmitic acid, or stearic acid and the particles of substantially light-insensitive organic silver salts primarily comprise silver behenate, silver palmitate, or silver stearate.

5. The process according to claim 1, wherein said anionic surfactant is present in a molar ratio of greater than 0.25 with respect to the organic acid, and said silver salt is added at a rate between 0.03 mol/(mol organic silver salt×mm) and 0.7 mol/(mol organic silver salt×mm).

6. The process according to claim 1, wherein said anionic surfactant is present in a molar ratio of greater than 0.3 with respect to organic acid, and said silver salt is added at a rate between 0.04 mol/(mol organic silver salt×mm) and 0.3 mol/(mol organic silver salt×mm).

7. The process according to claim 1, wherein step (iii) of said production process is carried out such that part of the solution of organic acid salts produced in step (ii) of said process is present in a reaction vessel prior to silver salt addition and part thereof is added simultaneously with the addition of silver salt solution.

8. The process according to claim 7, wherein about 25 to 50% of the solution of organic acid salts produced in step (ii) is in said reaction vessel prior to silver salt addition.

9. The process according to claim 1, wherein said anionic surfactant is selected from the group consisting of alkylsulfonate salts, alkarylsulfonate salts, aralkylsulfonate salts, aryl sulfonate salts, alkylsulfate salts, aralkylsulfate salts, arylsulfate salts, alkarylsulfate salts and organic carboxylate salts.

10. The process according to claim 9, wherein said alkarylsulfonate salt is alkylbenzene sulfonate salt.

11. The process according to claim 9, wherein said alkarylsulfonate salt is an alkali or ammonium salt of an alkarylsulfonic acid.

12. The process according to claim 10, wherein said alkylbenzene sulfonate salt is an alkali or ammonium salt of an alkylbenzene sulfonic acid.

13. The process according to claim 1, wherein said dispersion of particles of substantially light-insensitive organic silver salts is subjected to ultrafiltration.

14. The process according to claim 1, wherein said particles of substantially light-insensitive organic silver salts are not associated with mercury and/or lead ions.

15. The process according to claim 1, wherein said organic acid is commercially available behenic acid, palmitic acid, or stearic acid.

16. A process for producing a dispersion of particles of substantially light-insensitive organic silver salts primarily containing silver behenate, in an aqueous medium, said process comprising:

(i) preparing an aqueous dispersion comprising one or more organic acids primarily containing behenic acid and an anionic surfactant;

(ii) substantially neutralizing said organic acids with aqueous alkali, thereby forming organic acid salts primarily containing behenic acid salt; and (iii) adding an aqueous solution of a silver salt to completely convert said organic acid salts into their silver salts primarily containing silver behenate;

wherein said anionic surfactant is present in a molar ratio of greater than 0.15 with respect to the organic acids, and said silver salt is added at a rate of between 0.025 mol/(mol organic silver salt×mm) and 2.25 mol/(mol organic silver salt×mm).

17. A process for producing a dispersion of particles of substantially light-insensitive organic silver salts primarily containing silver palmitate, in an aqueous medium, said process comprising:

(i) preparing an aqueous dispersion comprising one or more organic acids primarily containing palmitic acid and an anionic surfactant;

(ii) substantially neutralizing said organic acids with aqueous alkali, thereby forming organic acid salts primarily containing palmitic acid salt; and (iii) adding an aqueous solution of a silver salt to completely convert said organic acid salts into their silver salts primarily containing silver palmitate;

wherein said anionic surfactant is present in a molar ratio of greater than 0.15 with respect to the organic acids, and said silver salt is added at a rate of between 0.025 mol/(mol organic silver salt×mm) and 2.25 mol/(mol organic silver salt×mm).

18. A process for producing a dispersion of particles of substantially light-insensitive organic silver salts primarily containing silver stearate, in an aqueous medium, said process comprising:

(i) preparing an aqueous dispersion comprising one or more organic acids primarily containing stearic acid and an anionic surfactant;

(ii) substantially neutralizing said organic acids with aqueous alkali, thereby forming organic acid salts primarily containing stearic acid salt; and (iii) adding an aqueous solution of a silver salt to completely convert said organic acid salts into their silver primarily containing silver stearate;

wherein said anionic surfactant is present in a molar ratio of greater than 0.15 with respect to the organic acids, and said silver salt is added at a rate of between 0.025 mol/(mol organic silver salt×min) and 2.25 mol/(mol organic silver salt×min).

* * * * *